US006305475B1

(12) United States Patent
Carnahan

(10) Patent No.: US 6,305,475 B1
(45) Date of Patent: Oct. 23, 2001

(54) METHOD FOR SIMULTANEOUSLY INSTALLING MULTIPLE STRINGS WITHIN A WELLBORE AND RELATED TOOLS

(75) Inventor: Brent D. Carnahan, Bakersfield, CA (US)

(73) Assignee: Aera Energy LLC, Bakersfield, CA (US)

( * ) Notice: Subject to any disclaimer, the term of this patent is extended or adjusted under 35 U.S.C. 154(b) by 0 days.

(21) Appl. No.: 09/410,823

(22) Filed: Oct. 1, 1999

(51) Int. Cl.[7] ..... E21B 19/00; E21B 19/16

(52) U.S. Cl. ..... 166/313; 166/380; 166/382; 166/77.1; 166/97.5

(58) Field of Search ..... 166/77.1, 97.5, 166/241.1, 313, 380, 381, 382

(56) References Cited

U.S. PATENT DOCUMENTS

| | | | | |
|---|---|---|---|---|
| 2,999,543 | * | 9/1961 | Myres | 166/129 |
| 3,095,042 | | 6/1963 | Clark, Jr. et al. | 166/243 |
| 3,100,529 | | 8/1963 | McStravik et al. | 166/52 |
| 3,110,347 | | 11/1963 | Howard et al. | 166/285 |
| 3,330,349 | | 7/1967 | Owsley et al. | 166/285 |
| 5,377,763 | * | 1/1995 | Pearce et al. | 166/367 |

OTHER PUBLICATIONS

Disclosure, "Frank's Triple Tools."

* cited by examiner

*Primary Examiner*—David Bagnell
*Assistant Examiner*—Jennifer H Gay
(74) *Attorney, Agent, or Firm*—Christie, Parker & Hale, LLP

(57) ABSTRACT

A method of installing multiple strings within a wellbore. The method utilizes a carrier string having carrier string joints, a plurality of side strings each having side string joints, and a carrier tool for transferring the weight of the side strings to the carrier string permitting the side strings to be held, raised, and lowered within the wellbore by holding, raising, and lowering the carrier string. The carrier tool includes a body having a threaded through bore extending through the body and at least one threaded blind bore on the body. The method comprises the steps of engaging the carrier string joint into the carrier tool at the through bore so that the carrier string extends vertically upward and downward from the carrier tool, and engaging side string joints into the carrier tool at the at least one threaded blind bore.

30 Claims, 15 Drawing Sheets

FIG. 1A
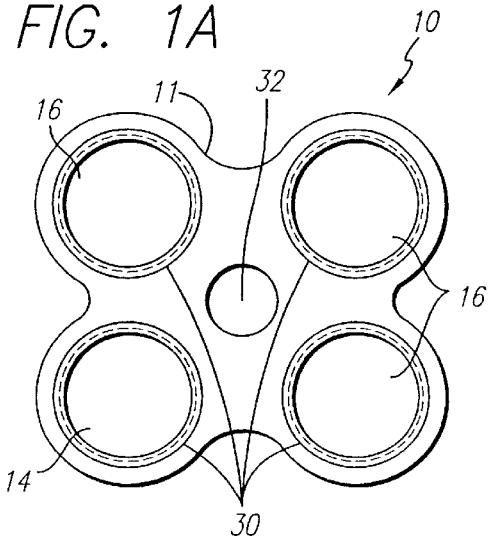
FIG. 1B
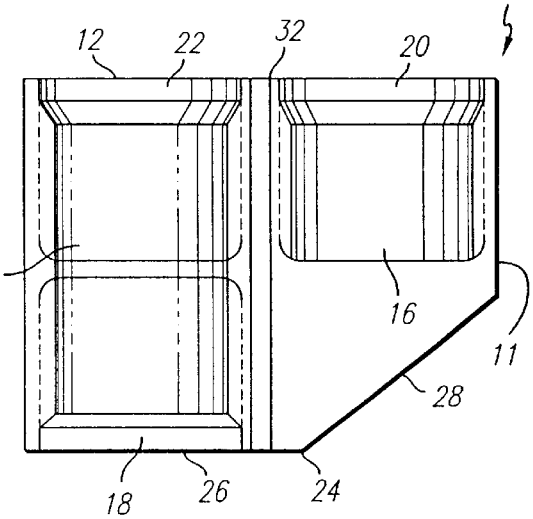
FIG. 2A
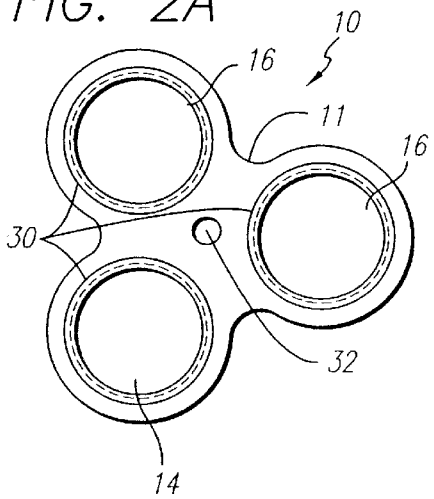
FIG. 2B
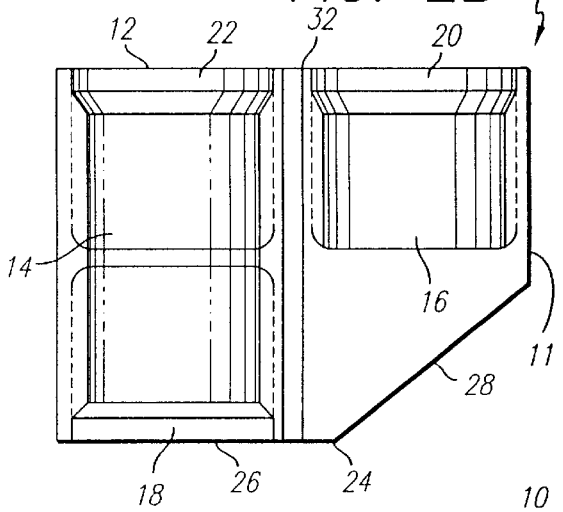
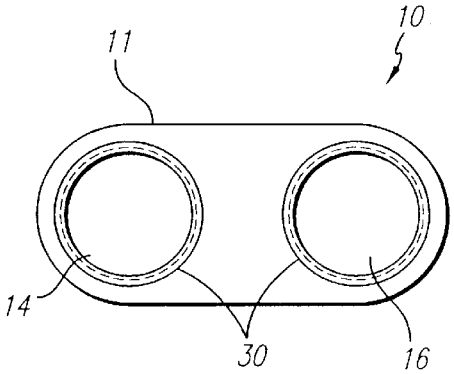
FIG. 3A
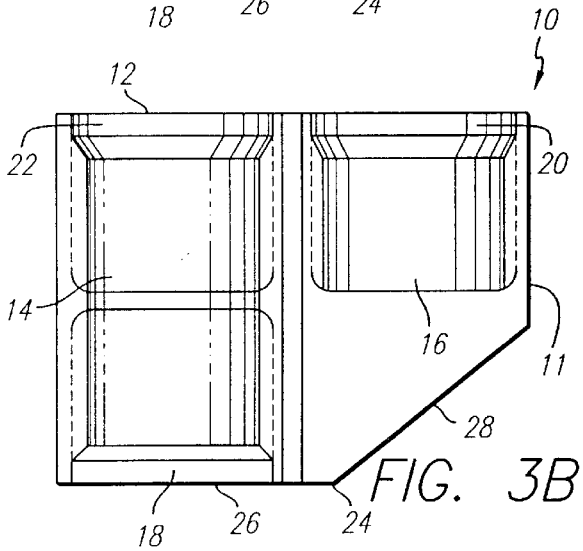
FIG. 3B FIG. 4A
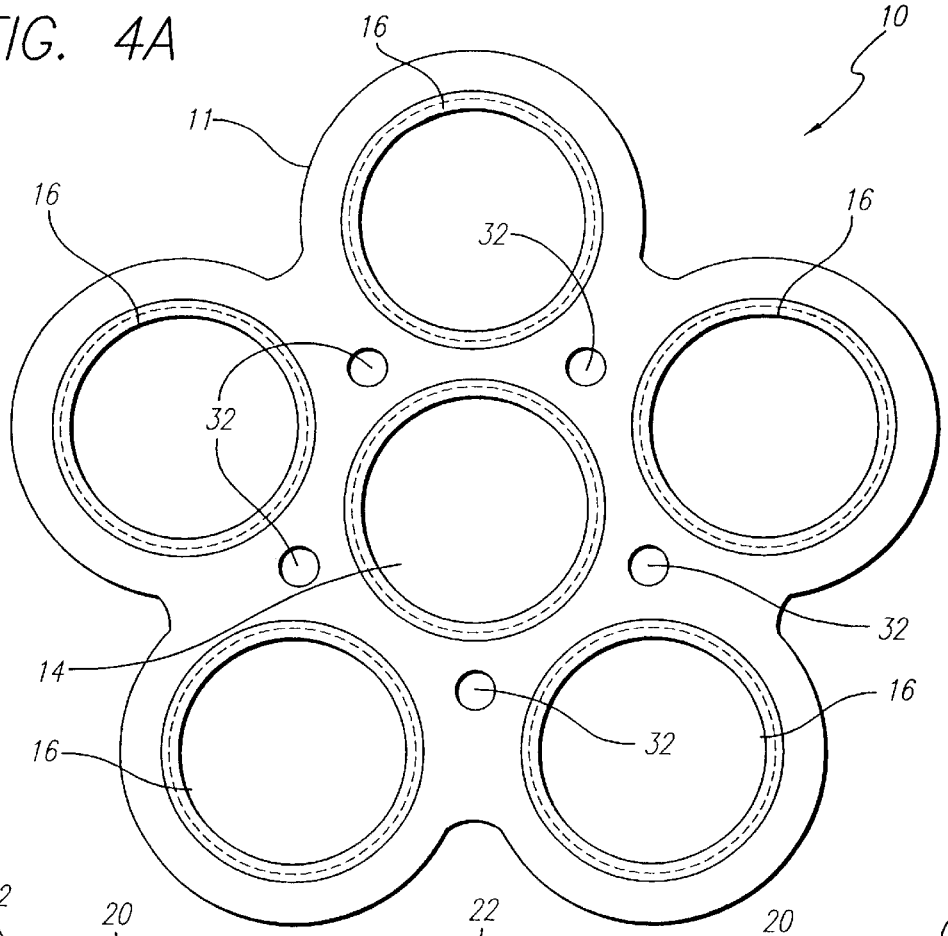
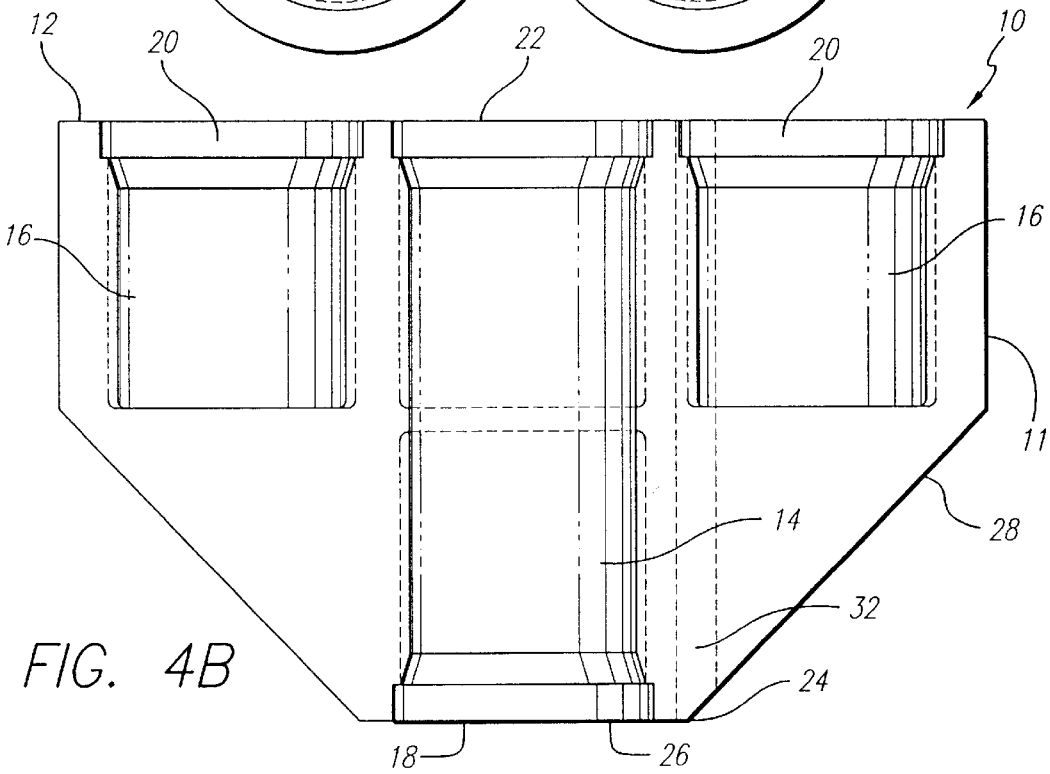
FIG. 4B

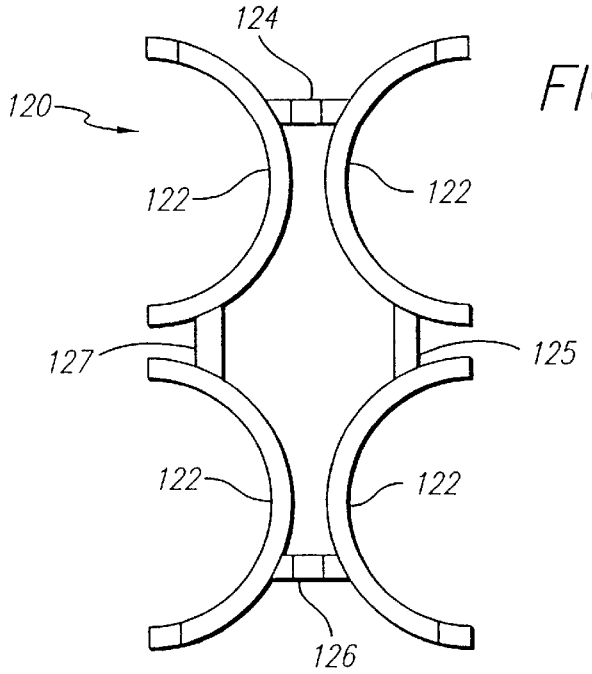
FIG. 12A
FIG. 12B
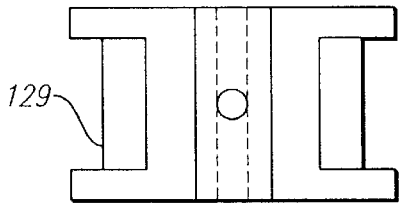
FIG. 12C
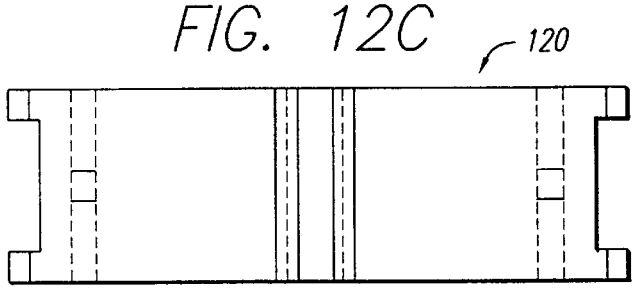
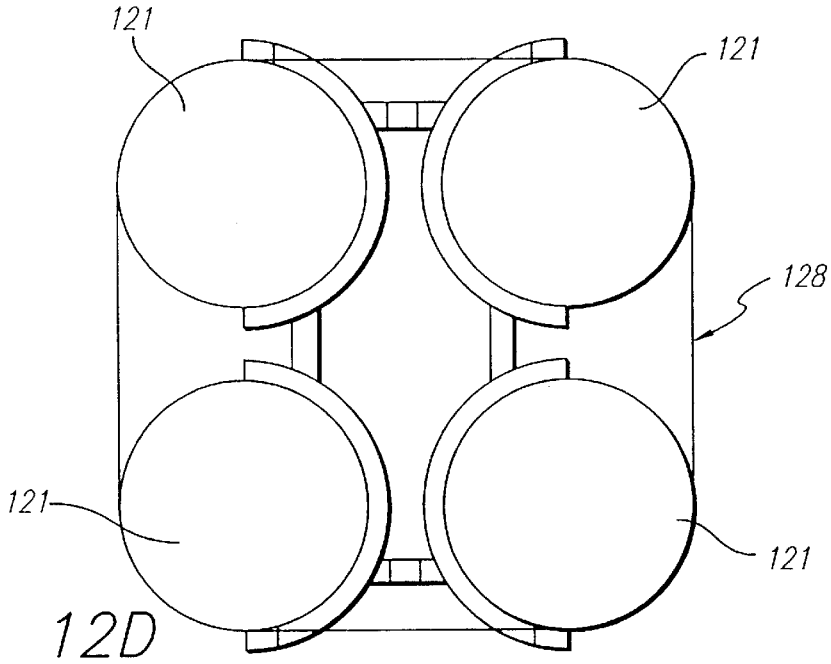
FIG. 12D

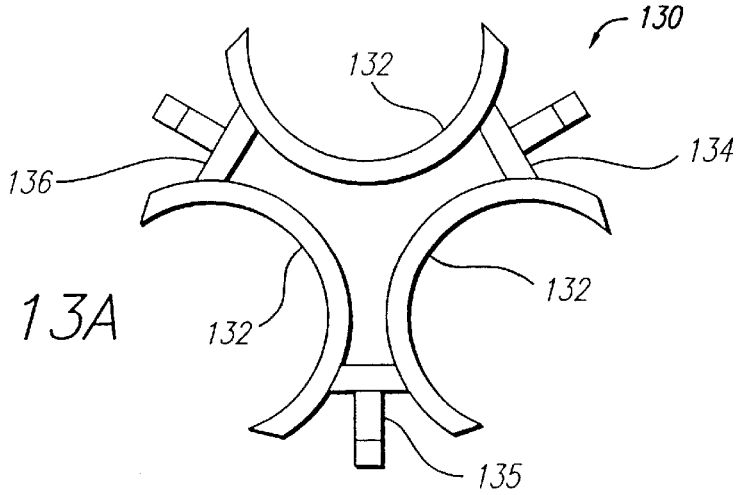
FIG. 13A
FIG. 13B
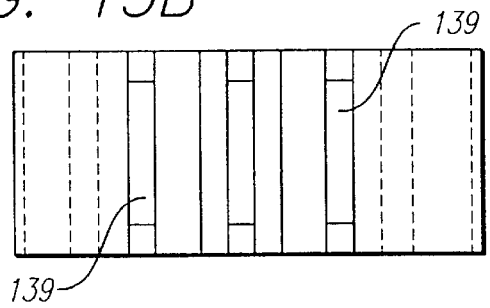
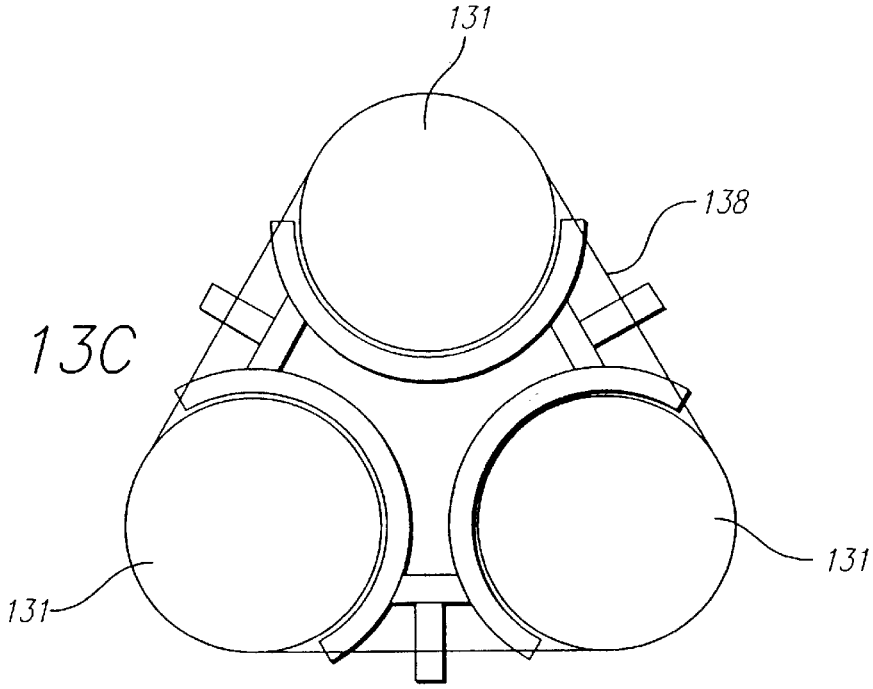
FIG. 13C

FIG. 14A
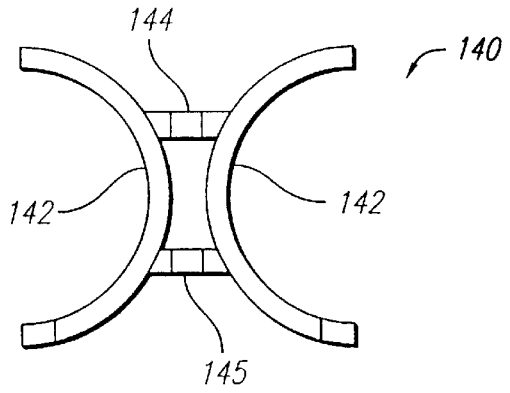
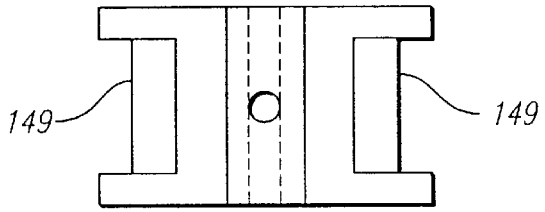
FIG. 14B
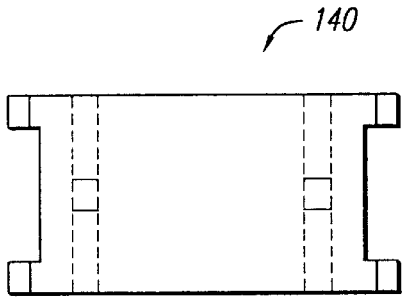
FIG. 14C
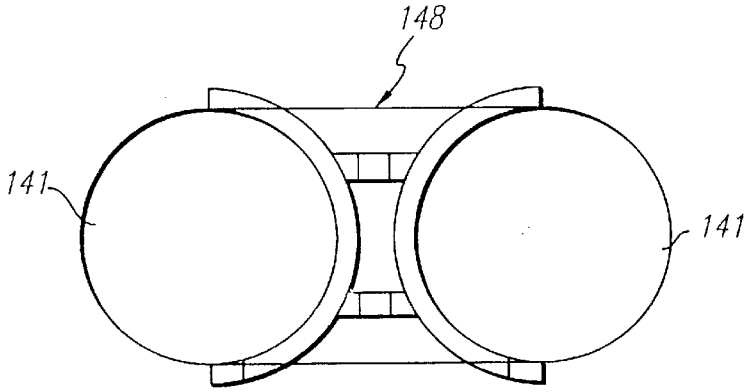
FIG. 14D

METHOD FOR SIMULTANEOUSLY INSTALLING MULTIPLE STRINGS WITHIN A WELLBORE AND RELATED TOOLS

BACKGROUND OF THE INVENTION

1. Field of the Invention

This invention relates in general to oil well drilling equipment, and, in particular, to a method for simultaneously installing multiple strings within a wellbore, and related tools.

2. Description of Related Art

The need to install multiple strings of tubing or casing (strings) into a well is well known in the art. For example, oil and gas wells may produce at two or more different zones within the well. A separate string is often installed into the well for each zone to be produced. Additionally, strings allow an operator to control the well's production by placing special tools and devices in or on the string. An example is the use of downhole chokes or surface adjustable regulators to control flow. Additionally, multiple strings may be utilized in injection wells to inject various fluids into the adjacent formation at different depths. In such uses, each string carries fluid at a unique pressure corresponding to the depth at which the fluid is being injected into the adjacent formation.

However, the installation of multiple strings is extremely time consuming and requires specialized handling equipment. Tubing or casing strings are comprised of individual joints which typically are available in three lengths. Range 1 tubing joints are about 20 to 24 feet whereas range 2 tubing joints are about 28 to 32 feet. Range 3 casing joints are about 38 to 42 feet long. Typically, joints are connected using threaded connections. Thus, installing a string to a modest depth of 3000 feet would require from 75 to 150 individual joints depending upon the range of the tubing/casing joint used. Using conventional installation procedures, the time required to run multiple strings to this depth linearly increases with the number of strings. That is, installing two strings generally takes about one and half to twice as long as installing a single string.

Strings are installed within a wellbore by connecting successive tubing/casing joints together and lowering the resulting string into the wellbore one joint at a time. An elevator is used to lift the tubing joint at one open end, direct the tubing joint over the open end of a string protruding from the wellbore, and lower the joint to the string where the joint can be rigidly connected to the string using a threaded connection. The string is suspended within the wellbore using a slip or spider which are well known in the art. This process is repeated until the string can be lowered to the desired depth within the wellbore. If a second string is required to be installed within the wellbore, the process is repeated again with the second string, if single string elevators and slips are being used. Alternatively, dual or triple elevators and slips can be used to install up to three strings simultaneously. However, if more than three strings are required to be installed within the wellbore, then the entire process must be repeated again. Consequently, there is a need for a method and apparatus for simultaneously installing more than three strings within a wellbore.

As noted above, existing methods of simultaneously installing multiple strings in a wellbore have been limited to installing a maximum of three strings. However, such methods require a uniquely modified elevator to pick-up up to three joints as well as a specially designed slip to hold multiple strings while additional joints are being attached.

Further, annular blowout preventors used for well control during the installation of strings also must be specifically designed for multiple string installations. Thus, there is a need for a method and apparatus for simultaneously installing multiple strings in a wellbore utilizing conventional single string elevators, slips, and annular blowout preventors.

Additionally, one drawback of existing methods of simultaneously installing up to three strings is that such methods cannot utilize spacers or clamps to bundle the strings in order to optimize both the spacing and orientation of the strings. Tubular joints typically are not of the same length which results in considerable variation in the length and depth of the side strings after a number of joints have been installed. When clamps or spacers are used to rigidly bundle the strings together as they are installed simultaneously within the wellbore, the side strings will extend above the wellbore to different heights. Moreover, a dual or triple elevator lifting two or three tubing joints to maneuver them over the existing strings prior to connection must necessarily lift all strings to the same height. After the connections have been made, the design of the elevators necessitates that the tops of all strings are at the same height to be lifted off the slips. Consequently, all strings cannot continue to be installed simultaneously using a multi-string elevator unless additional effort is taken to use joints of exactly the same length, or unless the side strings are individually installed within the wellbore. Either way, the installation method loses its economy when clamps and spacers are used. Thus, a need exists for a method or apparatus of simultaneously installing multiple strings within a wellbore which can be used in combination with clamps or spacers intended to optimize string spacing and orientation.

Another problem with conventional methods of installing multiple strings in a wellbore is the tendency of the strings to twist relative to each other. When strings have been installed within a wellbore and cemented in place, the strings must be perforated so the strings can communicate directly with the adjacent formation. As discussed above, each string may be directed to a specific producing or injection zone within the wellbore, thereby requiring perforation at a depth different from the adjacent strings. However, damage to adjacent strings often occurs during perforation of a string because the string twist causes the perforating charges to be inadvertently mis-directed toward adjacent strings rather than the adjacent formation.

In practice, risk of damage to adjacent strings can be mitigated, but not entirely eliminated, by using shorter perforating guns. That is, perforating guns having a shorter length can be better oriented since the strings do not twist relative to each other significantly over a short length. The tradeoff is that instead of using a single perforating gun a 100 feet long to perforate a string over a 100 foot region, ten perforating guns 10 feet long must be used to perforate a string over the same 100 feet region. Thus, there is a need for a method and apparatus of installing multiple strings in a wellbore that maintains the relative orientation of the strings (i.e., no twisting) to avoid damage to adjacent strings during perforation.

Another problem with conventional methods of installing multiple strings in a wellbore is the tendency of the strings to come into contact with each other owing to the random deviation of the well from vertical. Sufficient space between the strings is required in order to obtain cement fillage and the resulting hydraulic isolation between strings. Hydraulic isolation between strings is necessary to avoid fluid or pressure communication from one string to another. Further, a minimum distance between the strings is required where the strings are used to inject steam into the formation at different temperatures. This distance is optimized once the thermal conductivity of the cement between strings is known. If the distance is not optimal, one string will transfer heat to other strings resulting in the injection of steam into the formation at non-optimal quality (i.e., vapor content). Consequently, there is a need for a method of simultaneously installing multiple strings in a wellbore to properly space the strings from one another.

Another problem with existing methods of simultaneously installing multiple strings within a wellbore is well control during the installation of the strings. Oil well drill operators must have a means of sealing the wellbore in the event that high pressure within the wellbore forces gas or oil up through the well during installation. Typically, such means are known as blowout preventors. Annular blowout preventors are mounted below the rig floor and seal around a single string to close the wellbore and prevent the high pressure gas or oil from blowing out of the wellbore. During the simultaneous installation of multiple strings using existing methods, more than one string extends from the wellbore. Thus, annular blowout preventors must be modified to seal around more than a single string in such installations. The modification is specific to the number of strings being installed. Thus, there is a need for an apparatus and method of installing multiple strings within a wellbore which can be used with less costly and readily available single string annular blowout preventors for well control.

Accordingly, there has existed a definite need for a simple and economical method and apparatus for simultaneously installing multiple strings within a wellbore in a manner which addresses the shortcomings present in existing methods as identified above. The present invention satisfies these needs and provides further related advantages.

SUMMARY OF THE INVENTION

To overcome the limitations in the prior art described above, and to overcome other limitations that will become apparent upon reading and understanding the present specification, the present invention discloses a method for simultaneously installing multiple strings within a wellbore, and related tools.

This invention provides a method for simultaneously installing multiple strings within a wellbore, including installation of more than three strings. Further, the present invention also provides a carrier tool utilized in the method for simultaneously installing multiple strings within a wellbore. The carrier tool attaches to a carrier string and side strings in a manner that permits the carrier string and side strings to be suspended, raised or lowered within the wellbore by simply suspending, raising, or lowering the carrier string. Moreover, the present invention can be used in combination with clamps and spacers to prevent string twisting and to optimize string spacing within the wellbore. Further, the present invention permits the use of existing single string elevators, slips, and blowout preventors without requiring any modification to accommodate the simultaneous installation of multiple strings.

The method of the present invention is performed atop a rig floor positioned over the wellbore and blowout preventors. After initially attaching a carrier string and side string (s) to a carrier tool, the carrier string and side string(s) are lowered into the wellbore by lowering the carrier string using an elevator until the carrier string extends above the rig floor and the side string(s) are below the rig floor. Next, the carrier string and side string(s) are suspended within the wellbore by landing the carrier string in a slip assembly on the rig floor. With the carrier string and side string(s) suspended within the wellbore, the elevator may be used to pick up a carrier string joint and maneuver it so that it can be attached to the carrier string extending above the wellbore. After the carrier string connection has been made, string weight is transferred from the slip back to the elevator. The slips are retracted sufficiently to allow the side string(s) to pass through the slip assembly. Then, after retracting the slip, the elevator raises the carrier string and side string(s) by lifting the carrier string until the side string(s) also are above the rig floor. With the carrier string and side string(s) suspended by the elevator, a second elevator or winch line (or alternative lifting device) is used to pick up side string joints one at a time and maneuvers them so that they can be attached to the side string(s) extending above the wellbore. Then, the elevator suspending the carrier string lowers the carrier string until the carrier string extends above the rig floor and the side string(s) are below the rig floor and the process of adding additional joints is repeated until the carrier string and side string(s) can be lowered into the wellbore to a desired depth.

The carrier tool comprises a body having an upper surface extending radially relative to the axis of the wellbore, an axially extending threaded through bore extending through the body, and at least one axially extending threaded blind bore having its open end on the upper surface of the body. A carrier string having a plurality of carrier string joints engages the axially extending threaded through bore at the upper and lower surfaces of the carrier tool. At least one side string having a plurality of side string joints engages the carrier tool at the at least one axially extending threaded blind bore. This structural arrangement allows the carrier tool to transfer the weight of the side strings to the carrier string enabling the side strings to be suspended, raised, or lowered by suspending, raising, or lowering the carrier string. The carrier tool also defines the spacing and orientation of the strings relative to each other.

Thus, the carrier tool of the present invention enables the simultaneous installation of multiple strings in a wellbore, including configurations with more than three strings, in less time than conventional methods. Further, the present invention permits the use of single string elevators, slips, and annular blowout preventors without modification. Existing methods of simultaneously installing up to three strings within a wellbore require modified elevators (triple elevators) and modified slips (triple slips). Further, the present invention allows for the use of single string annular blowout preventors since, at any time during the installation, the side string(s) can be lowered into the wellbore so that only the carrier string extends through the blowout preventor and above the wellbore. If required, the blowout preventor may be closed on the carrier string. Thus, such a configuration mirrors a single string installation for purposes of using a single string annular blowout preventor for well control.

To prevent the carrier string and side string(s) from twisting relative to each other within the wellbore and to maintain proper spacing of the carrier string and side strings, the present invention includes clamps which are rigidly attached to the carrier string and side strings. The clamps are attached intermittently along segments of the carrier string and the side string(s) where the carrier string and or side strings will be perforated. The placement of the clamps corresponds to intended perforating zones within the wellbore after the strings have been lowered into the wellbore.

Some allowance is made in determining the location of clamps for any inherent depth measurement inaccuracy. Along segments of the carrier string and side string(s) where proper string spacing is required, but a rigid orientation of the carrier string and side string(s) is not required, i.e., segments other than the perforated segments, spacers can be substituted for clamps.

One advantage of using clamps is the ability to use the longer perforating guns to create perforations over a greater interval of the strings in a single gun run. Because the carrier string and side strings are rigidly attached and prevented from twisting relative to each other, perforating charges can be directed from within the strings toward the adjacent formation without risk that the charges will be inadvertently directed to adjacent strings. Without the use of clamps to maintain a rigid orientation, shorter perforating guns can be used to mitigate the risk of damaging adjacent strings caused by mis-orienting the perforating charges due to string twist, but the use of such guns requires more time and effort to perforate the same region of the strings.

Other features and advantages of the present invention will become apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1A is a top view of a carrier tool having an axially extending threaded through bore and three axially extending threaded blind bores;

FIG. 1B is a side view of the carrier tool of FIG. 1A.

FIG. 2A is a top view of a carrier tool having an axially extending threaded through bore and two axially extending threaded blind bores;

FIG. 2B is a side view of the carrier tool of FIG. 2A.

FIG. 3A is a top view of a carrier tool having an axially extending threaded through bore and one axially extending threaded blind bore;

FIG. 3B is a side view of the carrier tool of FIG. 3A;

FIG. 4A is a top view of a carrier tool having an axially extending threaded through bore and five axially extending threaded blind bores;

FIG. 4B is a side view of the carrier tool of FIG. 4A;

FIG. 12A is a top view of a four string spacer;

FIG. 12B is a side view of the four string spacer of FIG. 12A;

FIG. 12C is a front view of the four string spacer of FIG. 12A;

FIG. 12D is a top view of the four string spacer of FIG. 12A with a band around the carrier and side strings;

FIG. 13A is a top view of a three string spacer;

FIG. 13B is a side/front view of the three string spacer of FIG. 13A;

FIG. 13C is a top view of the three string spacer of FIG. 13A with a band around the carrier and side strings;

FIG. 14A is a top view of a dual string spacer;

FIG. 14B is a side view of the dual string spacer of FIG. 14A;

FIG. 14C is a front view of the dual string spacer of FIG. 14A;

FIG. 14D is a top view of the dual string spacer of FIG. 14A with a band around the carrier and side string;

DETAILED DESCRIPTION OF THE PREFERRED EMBODIMENT

Figure 5A:
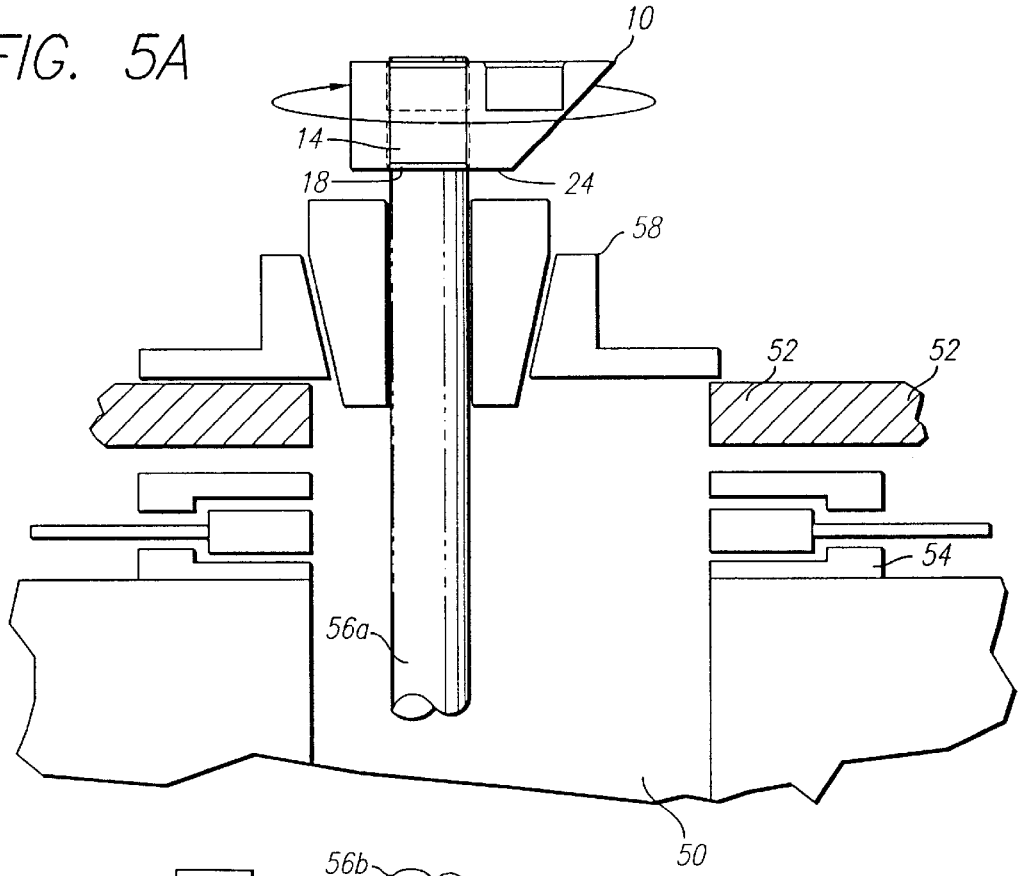
FIG. 5A is a perspective view of a carrier tool being attached to a carrier string joint suspended within a wellbore by a single string slip.

As shown in the exemplary drawings, the present invention includes a carrier tool, indicated generally by the reference numeral 10, for transferring the weight of side strings to a carrier string enabling the side strings to be suspended, raised or lowered by suspending, raising, or lowering the carrier string. As shown in a four string configuration in FIGS. 1A and 1B, the carrier tool 10 comprises a body 11 having an upper surface 12 extending radially relative to the axis of a wellbore (not shown), an axially extending threaded through bore 14 extending through said body 11 for attaching the carrier string (not shown), and three axially extending threaded blind bores 16 in said body 11 for attaching the side strings (not shown). Additionally, the threaded through bore 14 includes openings 18 and 22 and the threaded blind bores 16 include openings 20 which are slightly larger than the diameter of the bores. The slightly larger openings 18, 20 and 22 are tapered to permit the carrier string and side strings to be self-centering when inserted into the threaded through bore and threaded blind bores, respectively. In the preferred embodiment, the body 11 includes a lower surface 24 having a flat region 26 at the through bore opening 18 and tapered in a region 28 to facilitate insertion of the carrier tool 10 into the wellbore. A center hole 32 located at the center of the body 11 provides a pathway for fluid flow during circulating and cementing operations. This promotes good cement fillage between strings.

The carrier tool 10 is preferably made of steel or another material that is rigid enough to support the weight of the side strings at their maximum length. Further, the diameter of the bores 14 and 16 must be constructed to correspond to the outer threaded diameter of the carrier string joint and side string joints so that the carrier string joint and side string joints can engage the through bore and blind bores by threading the strings into the bores, respectively. In this regard, the carrier string joint and side string joints can engage the through bore 14 and side bores 16 by means other than integral threads 30. For example, the carrier string joint and side string joints can be welded to the through bore and blind bores.

In alternative embodiments, the carrier tool 10 can be constructed with a through bore 14 and blind bores 16 of different sized diameters provided that the diameters correspond to the outer threaded diameters of the carrier string joint and side string joints, respectively. Additionally, the carrier too 10 can be constructed with any number of blind bores 16 depending upon the specific application. For example, while exemplary configurations showing a carrier too 10 with one, two, three and five blind bores 16 have been described below, the present invention is not limited only to these configurations. Other configurations of the carrier tool 10 having four blind bores 16 or more than five blind bores 16 can be constructed using the principles disclosed in the present invention. In particular, the number of blind bores 16 is only limited by the diameter of the wellbore, the diameter of the tubing/casing joints, and the spacing requirements to ensure the side strings are thermally and hydraulically isolated.

In FIGS. 2A and 2B is shown a carrier tool 10 for simultaneously installing three strings. In this illustration, the carrier tool 10 comprises a body 11 having an upper surface 12 extending radially relative to the axis of a wellbore (not shown), an axially extending threaded through bore 14 extending through said body 11 for threadingly engaging the carrier string (not shown), and two axially extending threaded blind bores 16 in said body. Additionally, the threaded through bore 14 includes openings 18 and 22 and the threaded blind bores 16 include openings 20 which are slightly larger than the diameter of the bore. The slightly larger openings 18, 20 and 22 are tapered to permit the carrier string and side strings to be self-centering when inserted into the threaded through bore and threaded blind bores, respectively. In the preferred embodiment, the body 11 includes a lower surface 24 having a flat region 26 at the through bore opening 18 and tapered in a region 28 to facilitate insertion of the carrier tool 10 into the wellbore. A center hole 32 located at the center of the carrier tool 10 provides a pathway for fluid flow during circulating and cementing operations.

In FIGS. 3A and 3B is shown a carrier tool 10 for simultaneously installing two strings. In this illustration, the carrier tool 10 comprises a body 11 having an upper surface 12 extending radially relative to the axis of a wellbore (not shown), an axially extending threaded through bore 14 extending through said body 11 for threadingly engaging the carrier string (not shown), and a single axially extending threaded blind bore 16 in said body. Additionally, the threaded through bore 14 includes openings 18 and 22 and the threaded blind bore 16 includes opening 20 which are slightly larger than the diameter of the bore. The slightly larger openings 18, 20 and 22 are tapered to permit the carrier string and side string to be self-centering when inserted into the threaded through bore and threaded blind bore, respectively. In the preferred embodiment, the body 11 includes a lower surface 24 having a flat region 26 at the through bore opening 18 and tapered in a region 28 to facilitate insertion of the carrier tool 10 into the wellbore.

Figure 5B:
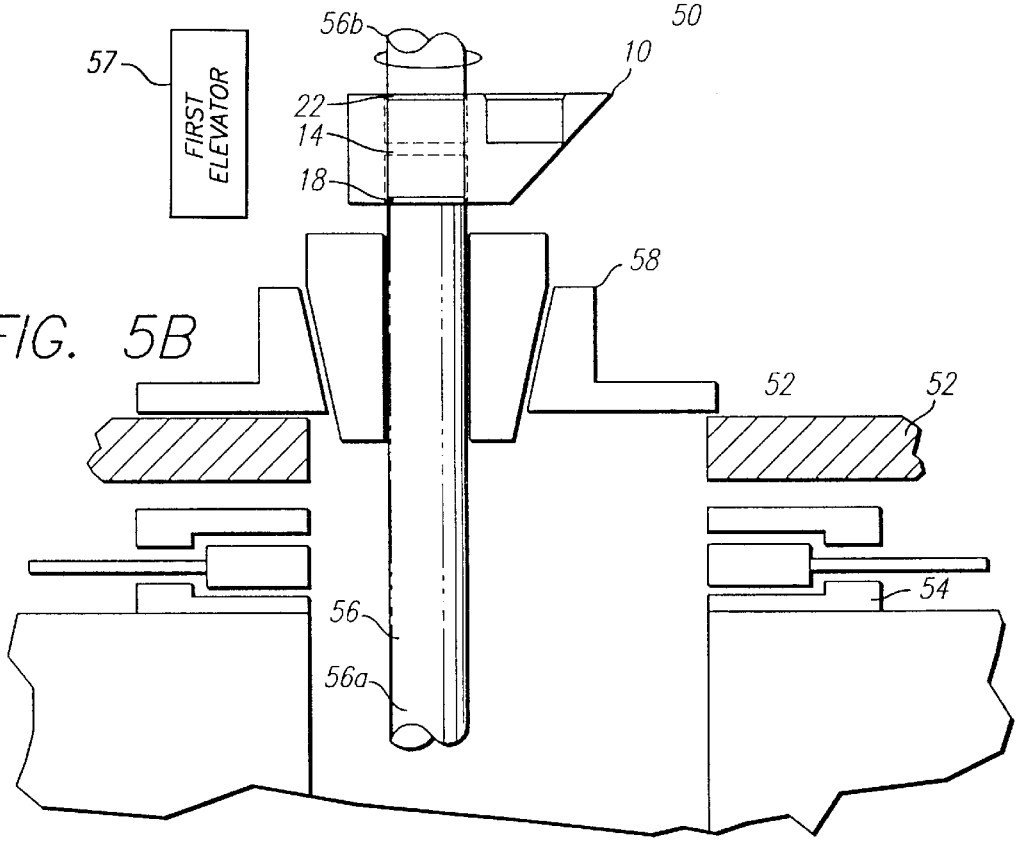
FIG. 5B is a perspective view of a carrier string joint being attached to the carrier tool and carrier string of FIG. 5A.
Figure 5C:
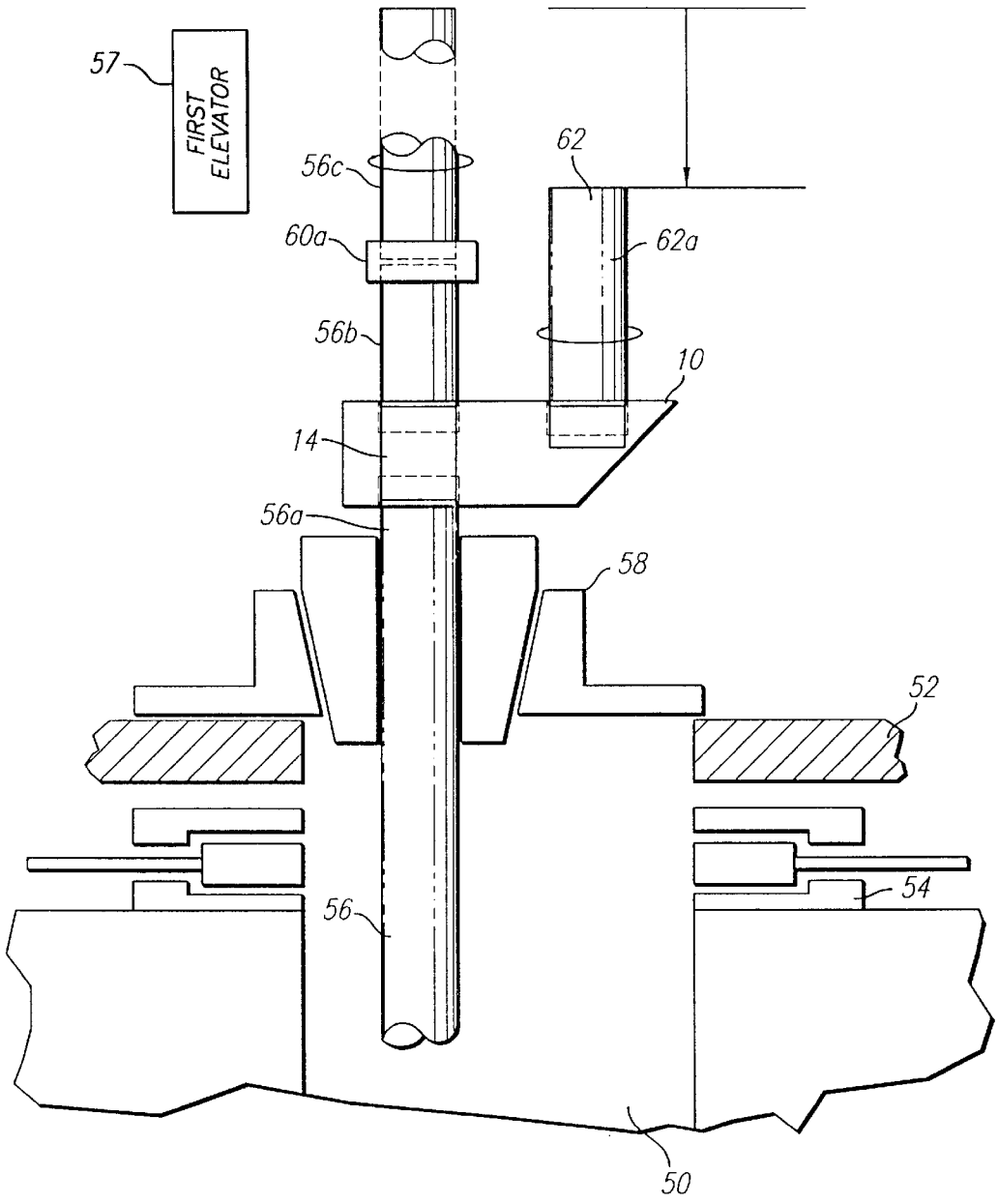
FIG. 5C is a perspective view of a side string joint being attached to the carrier tool and carrier string of FIG. 5B.

In FIGS. 4A and 4B is shown a carrier tool 10 for simultaneously installing six strings. In this illustration, the carrier tool 10 comprises a body 11 having an upper surface 12 extending radially relative to the axis of a wellbore (not shown), an axially extending threaded through bore 14 extending through said body 11 for threadingly engaging the carrier string (not shown), and five axially extending threaded blind bores 16 in said body. Additionally, the threaded through bore 14 includes openings 18 and 22 and the threaded blind bore 16 includes opening 20 which are slightly larger than the diameter of the bore. The slightly larger openings 18, 20 and 22 are tapered to permit the carrier string and side string to be self-centering when inserted into the threaded through bore and threaded blind bore, respectively. In the preferred embodiment, the body 11 includes a lower surface 24 having a flat region 26 at the through bore opening 18 and tapered in a region 28 to facilitate insertion of the carrier tool 10 into the wellbore. The threaded through bore 14 is located in the center of the carrier tool 10 with the threaded blind bores 16 located around the threaded through bore. Center holes 32 are located around the through bore 14 and inside of the blind bores 16. The center holes 32 provide a pathway for fluid flow during circulating and cementing operations. In a preferred embodiment as best shown in FIGS. 5A–5G, the carrier tool 10 of the present invention is utilized for the simultaneous installation of two strings within a wellbore 50. The installation is performed atop a rig floor 52 positioned over the wellbore 50 with a single string annular blowout preventor 54 installed between the rig floor and the top of the wellbore. Initially, as shown in FIG. 5A, a carrier string joint 56*a* is suspended within the wellbore 50 by a single string slip 58 mounted to the rig floor 52. The carrier tool 10 is attached to the carrier string joint 56*a* by positioning the open end 18 of the threaded through bore 14 on the lower surface 24 of the carrier tool onto the carrier string joint 56*a* and rotating the threaded through bore of the carrier tool down onto the carrier string joint. As shown in FIG. 5B, with the carrier tool 10 attached to the carrier string joint 56*a* suspended in the slip 58 over the wellbore 50, a second carrier string joint 56*b* is attached to the carrier tool 10 at the open end 22 of the threaded through bore 14 on the upper surface of the carrier tool 12. Using a first elevator 57 to lift the carrier string joint 56*b* over the carrier string 56, the carrier string joint is attached to the carrier tool 10 by threading the carrier string joint into the through bore 14 of the carrier tool. In a preferred embodiment, the carrier string joint 56*b* is approximately six (6) feet in length to create an offset between the carrier string 56 and the side string 62 (not shown) for reasons discussed below. After connecting the carrier string joint 56*b* to the carrier tool 10, a third carrier string joint 56*c*, shown in FIG. 5C, is coupled to carrier string joint 56*b* by again using the first elevator 57 to raise carrier string joint 56*c* and connect it to the carrier string 56. The carrier string joints 56*b* and 56*c* are connected using threaded connections of the kind known in the art. Carrier string joint 56*a*, 56*b*, and 56C are of normal size for the type of tubular joint being used.

Figure 5D:
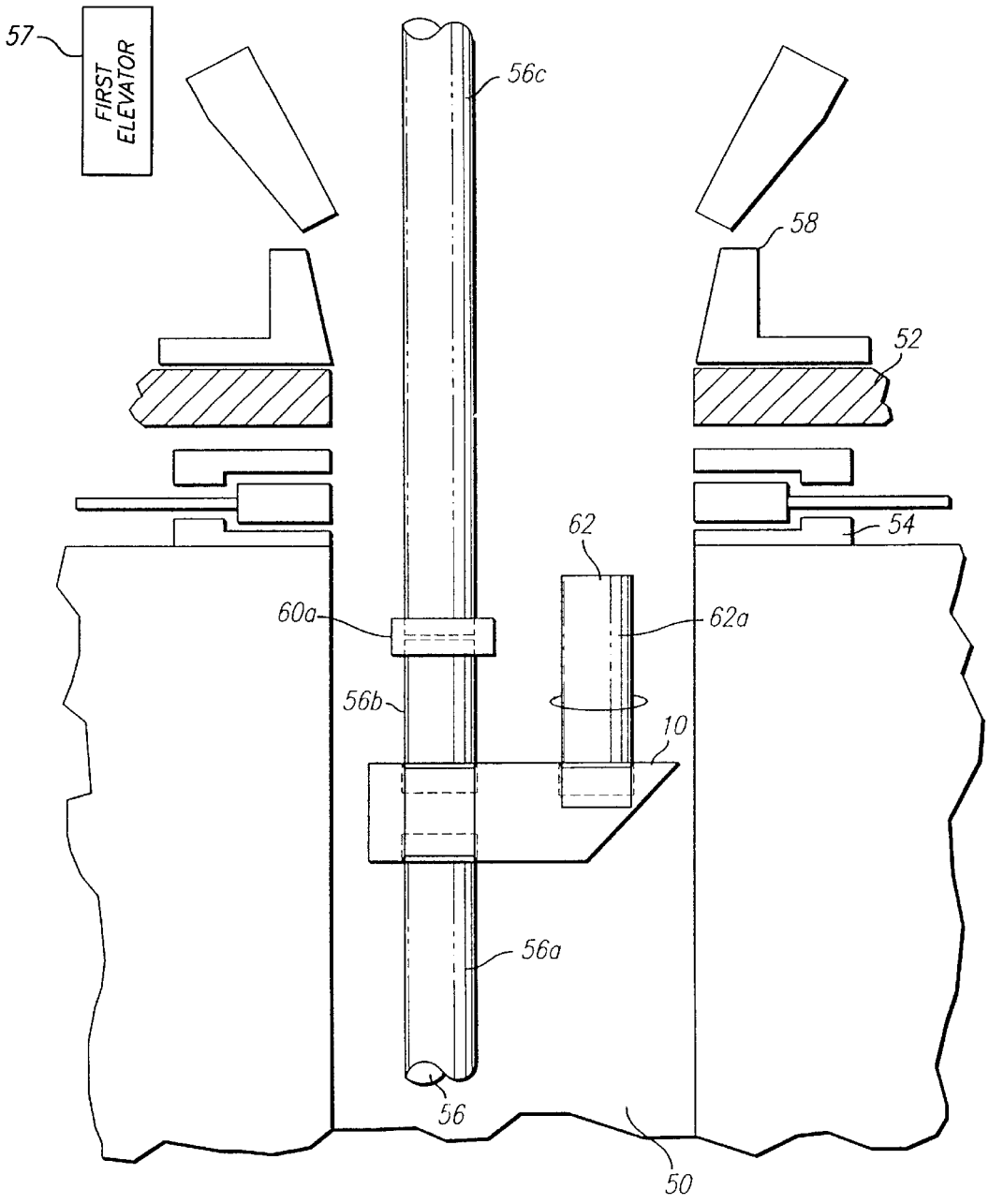
FIG. 5D is a perspective view showing the carrier tool, carrier string and side string of FIG. 5C supported by an elevator lowered within the wellbore so that the carrier string extends above the rig floor and the side string is below the rig floor and slip.

With the carrier string 56 suspended over the wellbore 50 by the slip 58, a side string joint 62*a* is connected to the carrier tool 10 by inserting one end of side string joint 62*a* into the threaded blind bore 16 of the carrier tool as shown in FIG. 5C. After side string joint 62*a* has been attached to the carrier tool 10, the top of the carrier string 56 should extend approximately the length of carrier string joint 56*b* above the top of the side string 62. Next, the first elevator 57 lowers the carrier string 56 and the side string 62 into the wellbore 50 through the open slip 58 by lowering the carrier string until the carrier string extends above the rig floor 52 and the side string is below the rig floor and slip. This configuration, shown in FIG. 5D, is possible because the six (6) foot carrier string joint 56*b* created an offset between the top of the carrier string 56 and the side string 62.

Figure 5E:
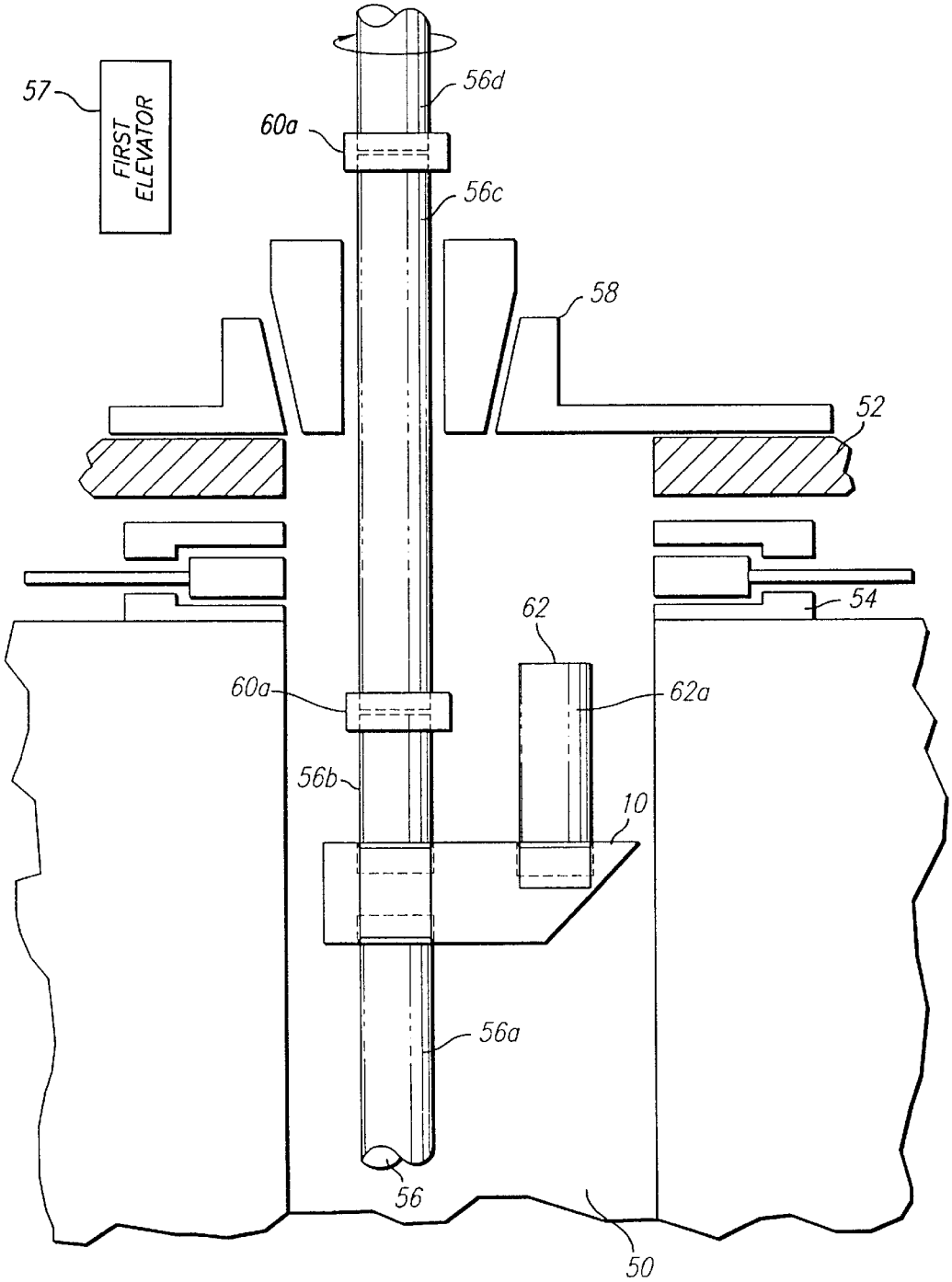
FIG. 5E is a perspective view of a carrier string joint being attached to the carrier tool, carrier string and side string of FIG. 5D suspended within the wellbore by a single string slip.
Figure 5F:
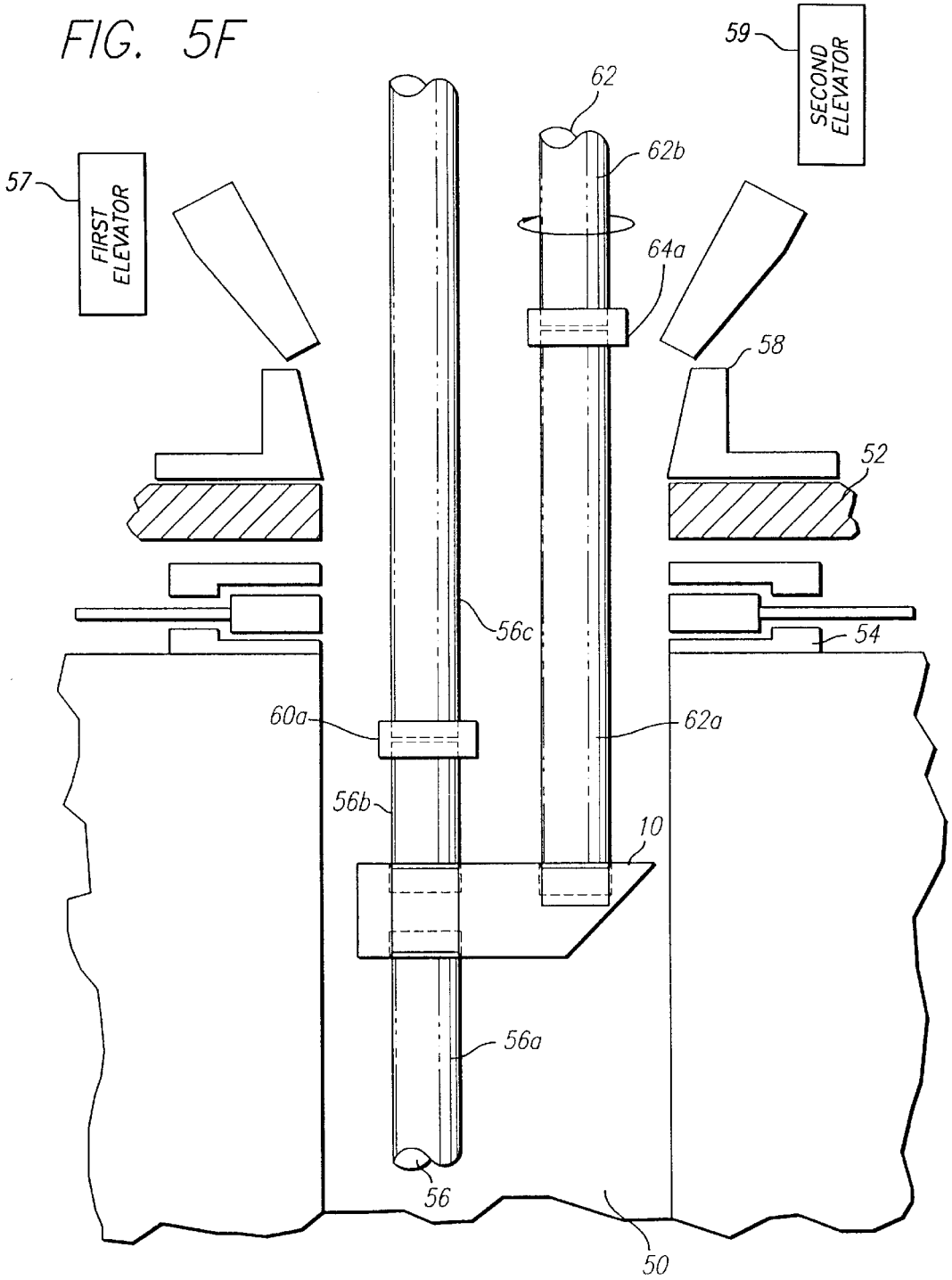
FIG. 5F is a perspective view of a side string joint being attached to the side string of FIG. 5E using a second elevator after raising the side string above the rig floor and suspending the side string by suspending the carrier string with the first elevator.

Next, as shown in FIG. 5E, the carrier string 56 and side string 62 are suspended within the wellbore 50 by landing the carrier string in a single string slip 58. When the carrier string 56 and side string 62 are suspended within the wellbore 50 by the sip 58, the first elevator 57 picks up a carrier string joint 56*d* and maneuvers it so that it can be attached to the carrier string extending above the wellbore. Then, as shown in FIG. 5F, the first elevator 57 raises the carrier string 56 and side string 62 by lifting the carrier string until the side string also is above the rig floor 52. The carrier string 56 and side string 62 are suspended within the wellbore 50 by the first elevator attached to the carrier string. A winch line or second elevator 59 then picks up side string joint 62*b* and maneuvers it so that it can be attached to the side string 62 extending above the wellbore 50. This process, as shown and described in reference to FIGS. 5D and 5F, is repeated until the carrier string 56 and side string 62 can be lowered into the wellbore 50 to the desired depth.

Figure 5G:
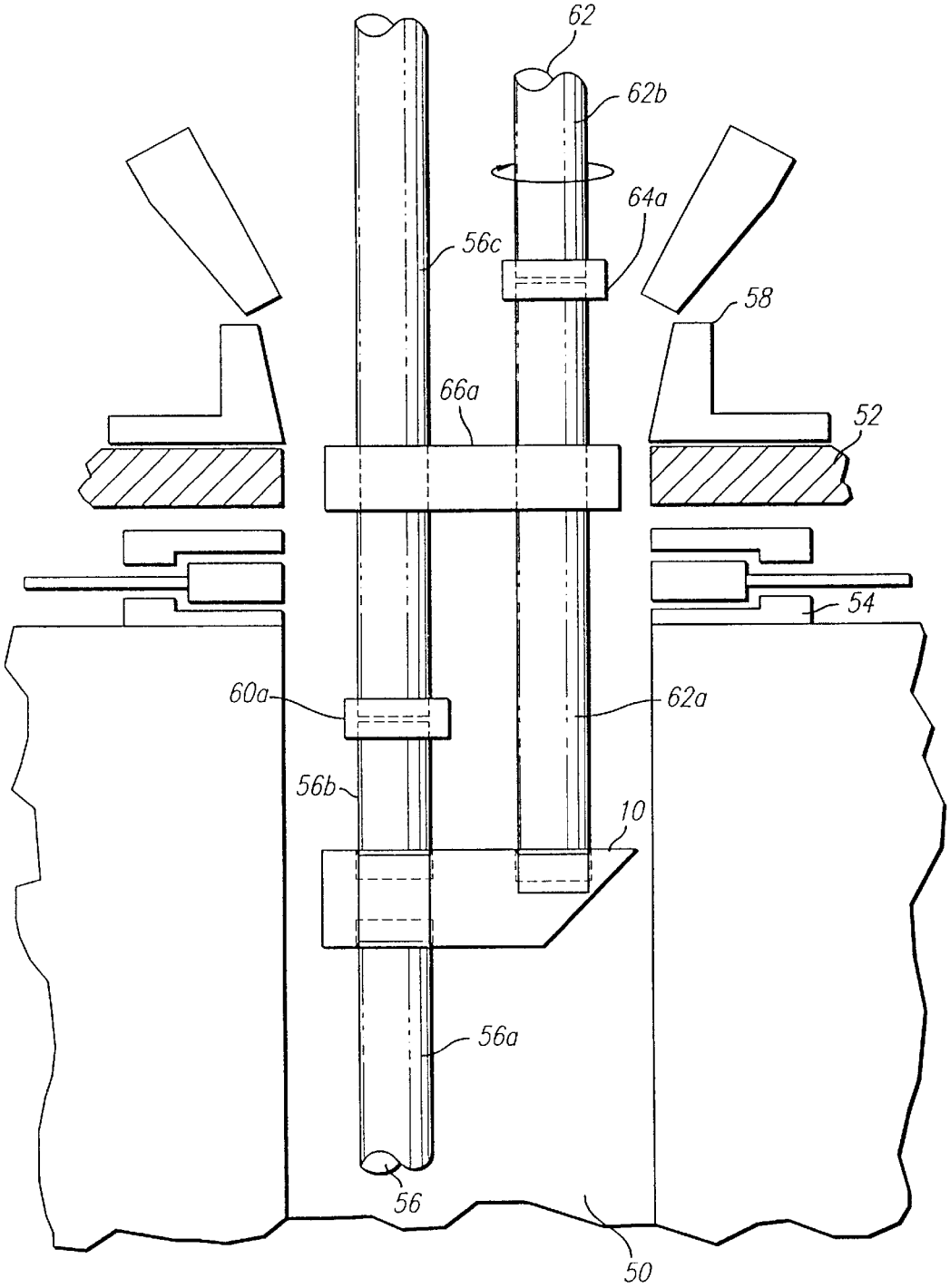
FIG. 5G is a perspective view of a clamp or spacer attached to the carrier tool, carrier string and side string of FIG. 5F.

In another embodiment of the present invention, the simultaneous installation of multiple strings within a wellbore further comprises securing the carrier string 56 and side string 62 together with a clamp 66*a*. In particular, FIG. 5G shows the two string installation of FIG. 5F in combination with a clamp 66*a*. The clamp 66*a* prevents the carrier string 56 and side string 62 from twisting relative to each other within the wellbore 50 and maintains proper spacing between the carrier string and side string. A rigid orientation is necessary in order to orient the perforating charges which will create holes in the carrier string 56 and or side string 62 in order for the carrier string and or side string to directly communicate with the adjacent formation. The clamp 66*a* is rigidly attached to the carrier string 56 and side string 62 intermittently along segments of the carrier string and the side strings where the carrier string and side string will be perforated. The perforated segments correspond to perforating zones (not shown) within the wellbore after the strings are lowered into the wellbore.

Along segments of the carrier string 56 and side string 62 where proper string spacing is still required, but a rigid orientation of the carrier string and side strings is not required, i.e., segments other than the perforated segments, spacers can be substituted for clamps. Spacers maintain a rigid distance between the carrier string 56 and each side string 62, but do not prevent the carrier string and side strings from twisting relative to one another. Clamps, on the other hand, are rigidly attached to both the carrier string 56 and each side string 62 in order to both prevent the carrier string or any side string from twisting relative to another string and maintain a rigid distance between the carrier string and each side string.

Figure 6:
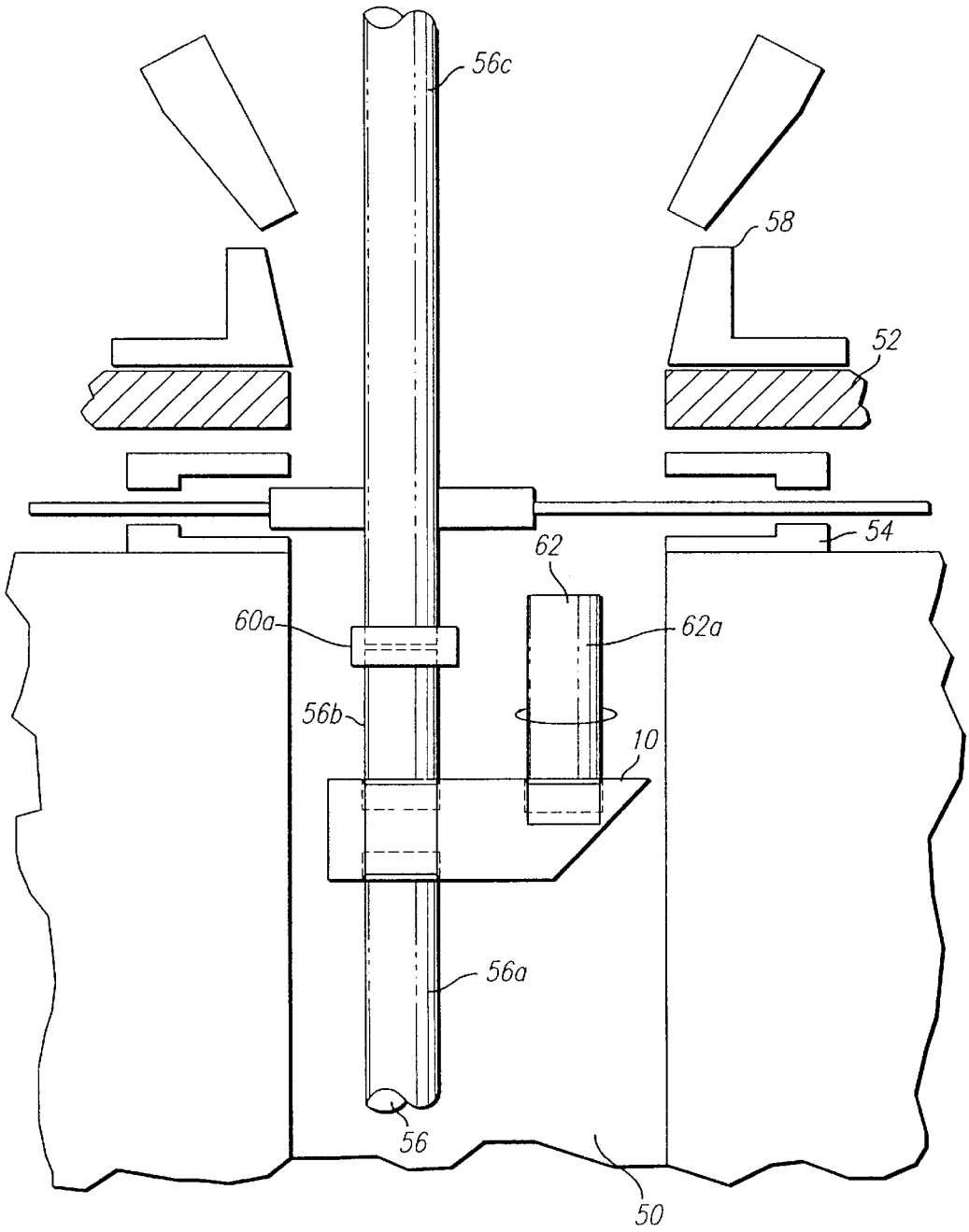
FIG. 6 is a perspective view of a single string blowout preventor closing on a carrier string joint within a wellbore with a single string slip retracted or open.

As shown in FIG. 6, the foregoing method enables the use of single string annular blowout preventors. In particular, in the event that an oil well operator must control the well to prevent high pressure oil or gas from erupting from the wellbore 50, the operator can lower the side string below the annular blowout preventor 54 in order to close the annular blowout preventor around the carrier string 56. In this configuration (with the side string below the closed annular blowout preventor), the slip 58 can be open or closed.

Figure 7:
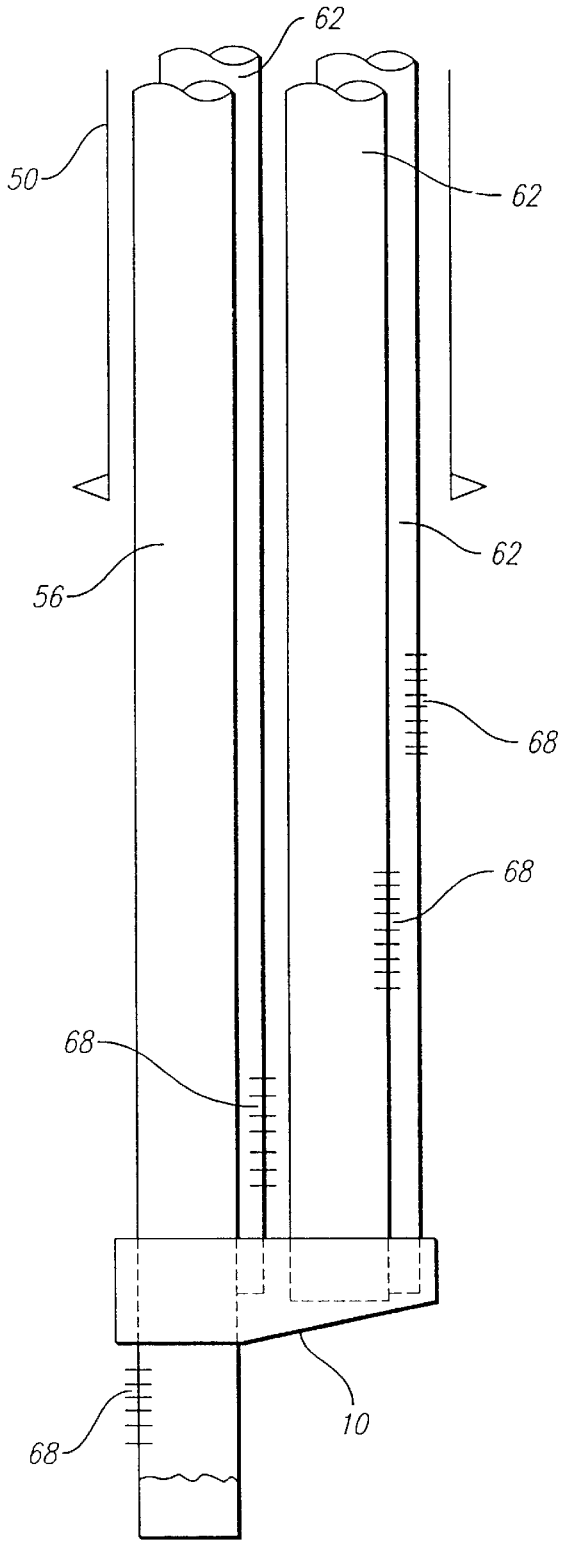
FIG. 7 is a perspective view of a four string installation including a four string carrier tool, a carrier string, and three side strings within a wellbore.

FIG. 7 illustrates a preferred embodiment of a four string installation resulting from the method of the present invention. Specifically, carrier string 56 and side strings 62 are installed within a wellbore 50. The carrier string 56 is connected to a carrier tool 10 by means of a threaded through bore. Side strings 62 are connected to the carrier tool 10 by means of threaded blind bores. Additionally, the carrier string 56 and side strings 62 are perforated along segments 68 corresponding to producing or injection zones within the wellbore 50 when the strings are lowered into the wellbore. The carrier string 56 and side strings 62 are each hydraulically and thermally isolated to optimize production or injection at a specific perforating or injection zone within the wellbore.

Figure 8:
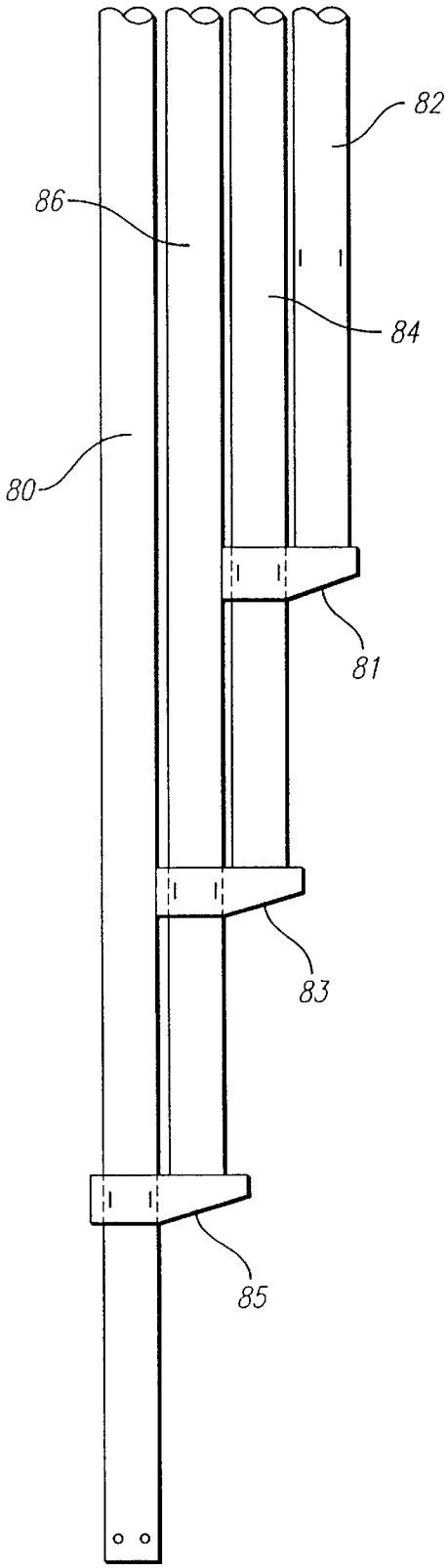
FIG. 8 is a perspective view of a four string installation including three two string carrier tools, a carrier string, and three side strings within a wellbore.

FIG. 8 illustrates an alternative embodiment of a four string installation using the method and tools of the present invention. In particular, a carrier string 80 is connected to three side strings 82, 84 and 86 by three two string carrier tools 81, 83 and 85, respectively. The carrier tools 81, 83 and 85 are oriented to enable each side string sufficient space free from interference from the other side strings. In a single four string carrier tool the orientation of the strings is defined by the position of the thread blind bores on the carrier tool which likewise must also be located to allow each side string to be free from interference from the other side strings. Thus, the method and tools of the present invention provides that numerous combinations of multi-string carrier tools can be used together for the simultaneous installation of multiple strings within a wellbore in addition to using a single multi-string carrier tool.

Figure 9A:
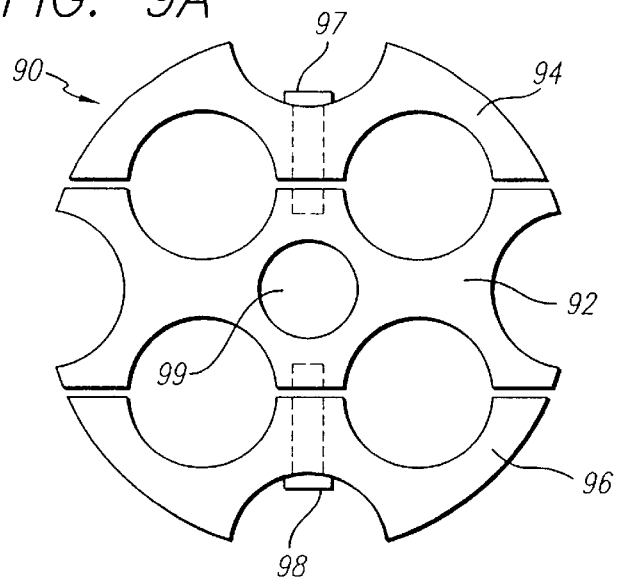
FIG. 9A is a top view of a four string clamp.
Figure 9B:
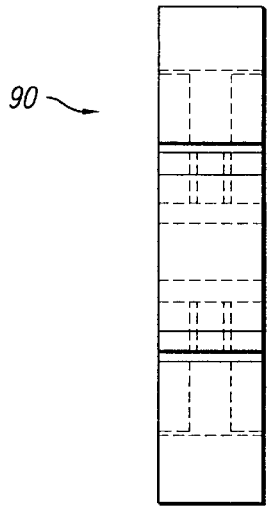
FIG. 9B is a side view of the clamp in FIG. 9A.

The method and tools of the present invention further disclose the use of clamps to prevent the carrier string and side string(s) from twisting relative to each other within the wellbore, and to maintain proper spacing between the carrier string and side string(s). As shown in FIGS. 9A and 9B, a four string clamp 90 comprises a center segment 92, a first outboard segment 94, and a second outboard segment 96. The first outboard segment 94 is rigidly fitted around two strings (not shown) and rigidly attached to the center segment 92 by a bolt 97. The second outboard segment 96 is rigidly fitted to the remaining two strings (not shown) and rigidly attached to the center segment 92 by a bolt 98. All segments are sized to provide a semi-circumferential concave shape equal to the semi-circumferential portion of the string's outer diameter to which the segment will mate in order to provide a secure and rigid fit. The four string clamp 90 also includes an axially extending hole 99 located at the center of the clamp to provide a pathway for fluid flow during circulating and cementing operations. In a preferred embodiment, clamps are installed every 30 feet along the string segments corresponding to perforating or injection zones within the wellbore.

Figure 10A:
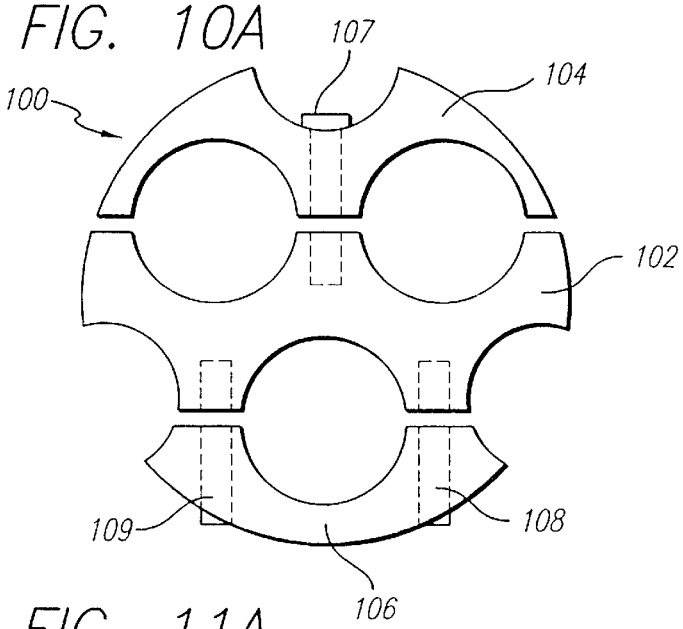
FIG. 10A is a top view of a three string clamp.
Figure 10B:
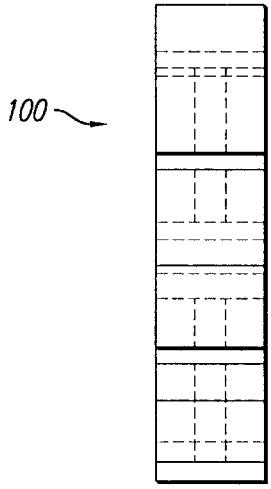
FIG. 10B is a side view of the clamp in FIG. 10A.

Similarly, FIGS. 10A and 10B disclose a three string clamp 100 comprising a center segment 102, a first outboard segment 104, and a second outboard segment 106. The first outboard segment 104 is rigidly fitted around two strings (not shown) and rigidly attached to the center segment 102 by a bolt 107. The second outboard segment 106 is rigidly fitted around the remaining string (not shown) and rigidly attached to the center segment 102 by bolts 108 and 109. All segments are sized to provide a semi-circumferential concave shape equal to the semi-circumferential portion of the string's outer diameter to which the segment will mate in order to provide a secure and rigid fit.

Figure 11A:
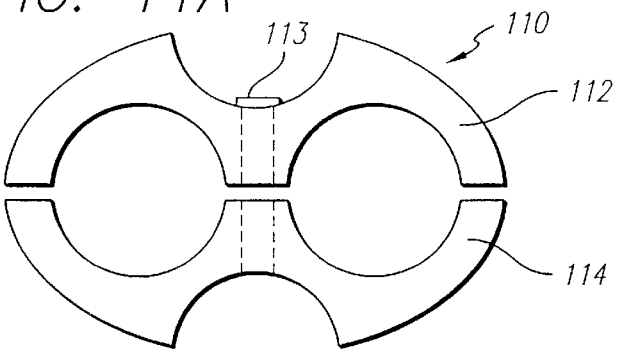
FIG. 11A is a top view of a dual string clamp.
Figure 11B:
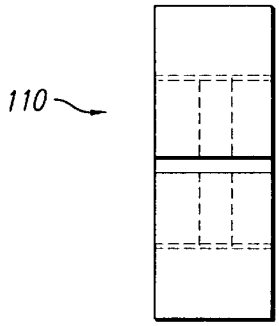
FIG. 11B is a side view of the clamp in FIG. 11A.

FIGS. 11A and 11B disclose a two string dual string clamp 110 comprising a first segment 112 and a second segment 114. The first segment 112 is rigidly fitted around two strings (not shown) and rigidly attached to the second segment 114 by a bolt 113. All segments are sized to provide a semi-circumferential concave shape equal to the semi-circumferential portion of the string's outer diameter to which the segment will mate in order to provide a secure and rigid fit.

The present invention further discloses the use of spacers to space the strings in order to hydraulically and thermally isolate the strings from one another. While the spacers maintain a fixed position of the strings relative to one another, the spacers do not prevent the strings from twisting relative to one another. Therefore, preferably spacers are not used along sections of the strings which will be perforated because of the potential risk of damage to the adjacent strings caused by mis-directing the perforating gun and creating holes in the adjacent strings due to the string twist. In a preferred embodiment, spacers are installed about every 30 feet along the string segments within the wellbore from the carrier tool to the surface.

FIGS. 12A–12D illustrates a preferred embodiment of a four string spacer tool disclosed in the present invention. With reference to FIG. 12A, the four string spacer tool 120 comprises four semi-circumferential shaped saddles 122 rigidly connected by a first, second, third and fourth saddle supports 124, 125, 126 and 127, respectively. As shown in FIG. 12D, the saddles 122 are positioned in a generally rectangular shape to receive four strings 121 so that the strings are received by the saddle at the interior circumferential sections of the strings. The saddles 122 are further secured to the strings by a steel band 128 as shown in FIG. 12D. The steel band 128 is wrapped around the exterior circumferential portion of the strings 121 forcing the strings against the saddles and thereby rigidly securing the strings within the saddles. As shown in FIG. 12B, the saddles 122 have notches 129 to receive the steel band 128.

FIGS. 13A–13C illustrates a preferred embodiment of a three string spacer tool disclosed in the present invention. The three string spacer tool 130 comprises three semi-circumferential shaped saddles 132 rigidly connected by a first, second, and third saddle supports 134, 135, and 136, respectively. As shown in FIG. 13C, the saddles 132 are positioned in a generally triangular shape to receive three strings 131 so that the strings are received by the saddle at the interior circumferential sections of the strings. The saddles 132 are further secured to the strings by a steel band 138 as shown in FIG. 13C. The steel band 138 is wrapped around the exterior circumferential portion of the strings 131 forcing the strings against the saddles and thereby rigidly securing the strings within the saddles. As shown in FIG. 13B, the saddles 132 and saddle supports 134, 135, and 136 have notches 139 to receive the steel band 138.

FIGS. 14A–14D illustrates a preferred embodiment of a two string spacer tool disclosed in the present invention. The two string spacer tool 140 comprises two semi-circumferential shaped saddles 142 rigidly connected by a first and second saddle supports 144 and 145, respectively. As shown in FIG. 14D, the saddles 142 are positioned in a generally square shape with the open end of the saddles facing opposite directions to receive two strings 141 so that the strings are received by the saddle at the interior circumferential sections of the strings. The saddles 142 are further secured to the strings by a steel band 148 as shown in FIG. 14D. The steel band 148 is wrapped around the exterior circumferential portion of the strings 141 forcing the strings against the saddles 142 and thereby rigidly securing the strings within the saddles. As shown in FIG. 14B, the saddles 142 have notches 149 to receive the steel band 148.

Figure 15A:
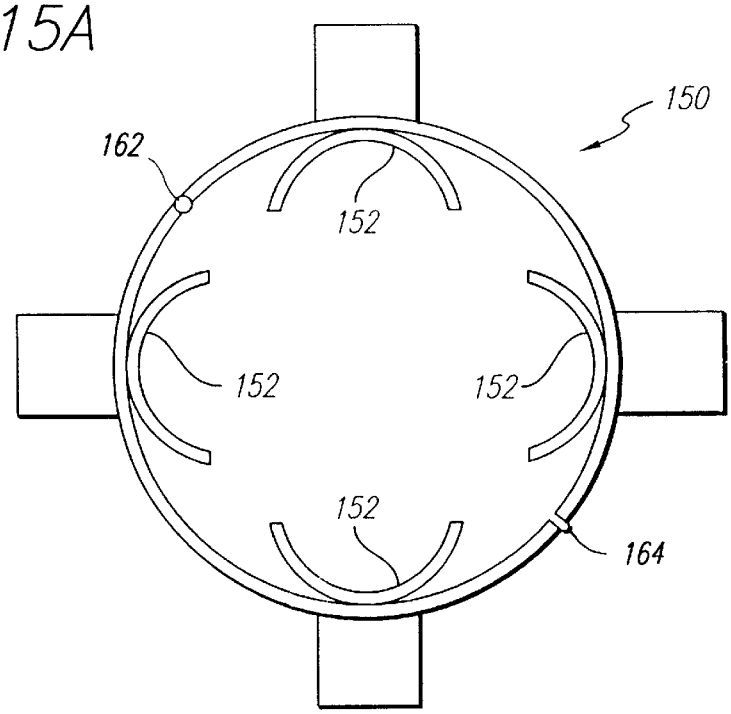
FIG. 15A is a top view of a four string centralizer.
Figure 15B:
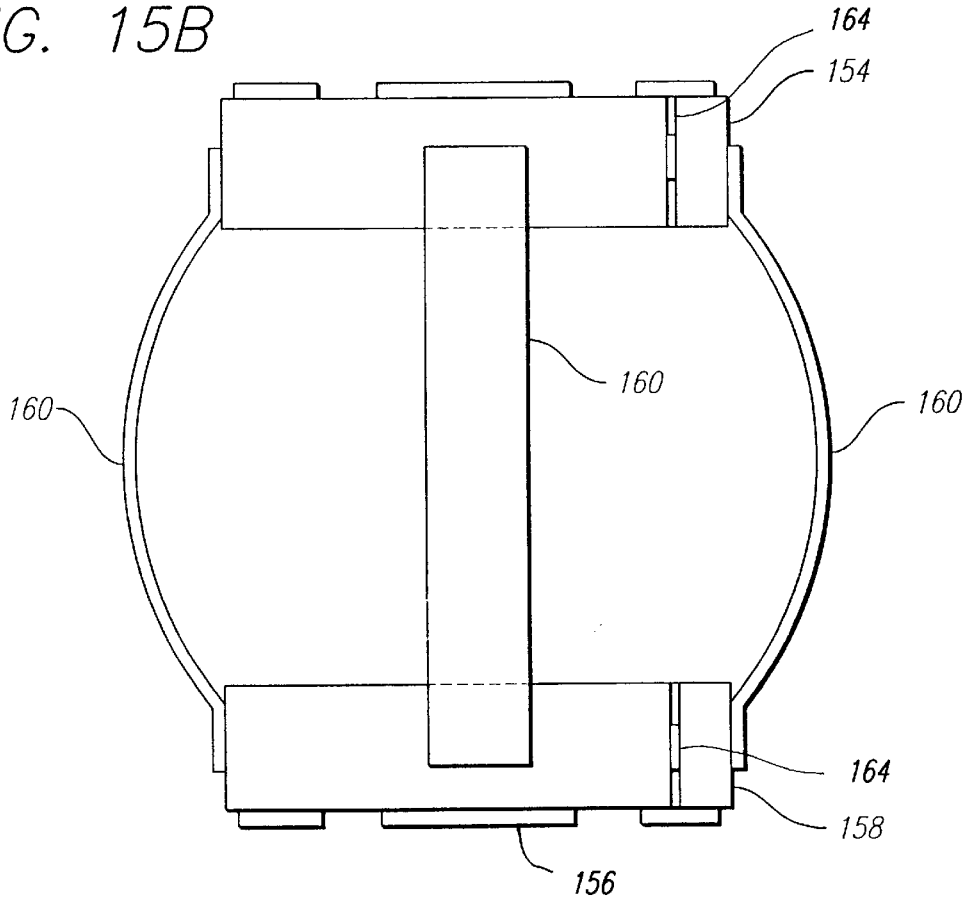
FIG. 15B is a side view of the four string centralizer of FIG. 15A.

FIGS. 15A and 15B illustrate a preferred embodiment of a four string centralizer tool disclosed in the present invention. The four string centralizer tool 150 comprises four semi-circumferential shaped saddles 152 rigidly attached to an upper collar 154 and four semi-circumferential shaped saddles 156 rigidly attached to a lower collar 158. The upper and lower collars 154 and 158 are connected by four steel bands 160 running parallel to the strings when the centralizer 150 is installed around the strings. The steel bands 160 act as bow springs positioned round the circumference of the collars 154 and 158 at about 0 , 90 , 180, and 270 degrees to oppose the side walls of the wellbore and force the strings to the center of the wellbore. The collars 154 and 158 of the centralizer 150 are positioned around the strings at a clamp or spacer. In a preferred embodiment, centralizers are attached about every 30 feet along segments corresponding to injection or producing zones within the wellbore, and about every 60 feet along the remaining sections.

From the foregoing, it will be appreciated that this invention allows a simple and effective method of installing multiple strings within a wellbore and discloses related tools. While a particular form of the invention has been illustrated and described, it will be apparent that various modifications can be made without departing from the spirit and scope of the invention. Accordingly, it is not intended that the invention be limited, except as by the appended claims.

With continued reference to FIGS. 15A and 15B, the centralizer of the present invention also includes a hinge 162 and a hinge latch 164 on both the upper and lower collars 154 and 158. The hinge allows the centralizer to be opened in a clamshell manner and to be fitted around a carrier and side string bundle by simply closing the centralizer and setting the latch.

What is claimed is:

1. A method of installing multiple strings within a wellbore, the method utilizing a carrier string having carrier strings joints, a plurality of side strings wherein each side string has side string joints, a carrier tool for transferring the weight of the side strings to the carrier string permitting the side strings to be held, raised, and lowered within the wellbore by holding, raising, and lowering the carrier string, the carrier tool having a threaded through bore, and at least one threaded blind bore, the method comprising the steps of:

engaging the carrier string joint into the carrier tool at the through bore wherein the carrier string extends vertically upward and downward from the carrier tool; and engaging each side string joint into the carrier tool at the at least one threaded blind bore.

2. The method of claim 1 wherein the carrier string and or side strings include segments which will be perforated, the perforated segments corresponding to a desired production or injection zone within the wellbore when the strings are lowered into the wellbore, the method further comprising the step of:

attaching clamps to the carrier string and side strings intermittently along the perforated segments, wherein the clamps maintain the spacing and orientation of the carrier string and side strings relative to one another.

3. The method of claim 2, wherein spacers are substituted for clamps along segments other than the perforated segments.

4. The method of claim 3, further comprising the step of:

attaching a centralizer to the carrier string and side strings immediately around each clamp or spacer to keep the carrier string and side strings centered within the wellbore.

5. The method of claim 4, wherein the at least one axially extending threaded blind bore comprises a single axially extending threaded blind bore.

6. The method of claim 4, wherein the at least one axially extending threaded blind bore comprises two axially extending threaded blind bores.

7. The method of claim 4, wherein at least one axially extending threaded blind bore comprises four axially extending threaded blind bores.

8. The method of claim 4, wherein the carrier joints and side string joints have an outer diameter (OD) of about 2⅜ inches.

9. The method of claim 1, wherein the method is performed on a rig floor with a single string slip assembly positioned over the fig floor and the wellbore, the method further comprising the steps of:

lowering the carrier string and side strings into the wellbore using a first elevator until the side strings are below the slip and the rig floor and the carrier string is above the rig floor and slip;

landing the carrier string in the slip to suspend the carrier string and side strings within the wellbore;

attaching one of the carrier string joints to the carrier string using the first elevator to lift the carrier string joint;

raising the carrier string from the wellbore with the first elevator until the side strings are above the rig floor;

suspending the carrier string with the first elevator to suspend the carrier string and side strings; and attaching additional side string joints to each side string using a second elevator or winch line to lift the side string joints.

10. The method of claim 9, further including the step of repeating the steps of claim 3 until the carrier string and side strings are lowered into the wellbore to a desired depth.

11. A method of installing multiple strings within a wellbore, the method being performed on a rig floor with a single string slip assembly positioned over the rig floor and the wellbore, the method utilizing a carrier string having a plurality of carrier string joints and at least one side string, each side string having a plurality of side string joints, the carrier string and/or the side strings including segments which will be perforated, the perforated segments corresponding to a desired production or injection zone within the wellbore when the carrier string and the side strings are lowered into the wellbore, the carrier string and the side strings being rigidly connected together using a clamp attached intermittently along the perforated segments, the carrier string and the side strings being intermittently attached by spacers along segments other than the perforated segments, wherein a centralizer is attached adjacent each clamp or spacer to keep the carrier string and the side strings centered within the wellbore, and a carrier tool for transferring the weight of the side strings to the carrier string permitting the side strings to be held, raised, or lowered, within the wellbore by holding, raising, or lowering the carrier string, the carrier tool having a threaded through bore, and at least one axially extending threaded blind bore, the method comprising the steps of:

engaging the carrier string joint into the carrier tool at the through bore wherein the carrier string extends vertically upwardly and downwardly from the carrier tool;

engaging each side string joint into the carrier tool at one of the threaded blind bores;

lowering the carrier string and the side strings into the wellbore using a first elevator until the side strings are below the slip and the rig floor and the carrier string is above the rig floor and slip;

landing the carrier string in the slip to suspend the carrier string and the side strings within the wellbore;

attaching one of the carrier string joints to the carrier string using the first elevator to lift the carrier string joint;

raising the carrier string from the wellbore with the first elevator until the side strings are above the rig floor;

suspending the carrier string with the first elevator to suspend the carrier string and the side strings;

attaching additional side string joints to each side string using a second elevator or winch line to lift the side string joints; and repeating the lowering, landing, attaching, raising, suspending, and attaching steps until the carrier string and the side strings are lowered into the wellbore to a desired depth.

12. A method of installing multiple strings within a wellbore, the method being performed on a rig floor with a single string slip assembly positioned over the rig floor and the wellbore, the method utilizing a carrier string having a plurality of carrier string joints and at least two side strings, each side string having a plurality of side string joints, the carrier string and/or side strings including segments which will be perforated, the perforated segments corresponding to a desired production or injection zone within the wellbore when the carrier string and side strings are lowered into the wellbore, the carrier string and side strings being rigidly connected together using a clamp attached intermittently along the perforated segments, the carrier string and side strings being intermittently attached by spacers along segments other than the perforated segments, wherein a centralizer is attached adjacent each clamp or spacer to keep the carrier string and side strings centered within the wellbore, and a carrier tool for transferring the weight of the side strings to the carrier string permitting the side strings to be held, raised or lowered, within the wellbore by holding, raising, or lowering the carrier string, the carrier tool having a threaded through bore, and at least two axially extending threaded blind bores, the method comprising the steps of:

engaging the carrier string joint into the carrier tool at the through bore wherein the carrier string extends vertically upwardly and downwardly from the carrier tool;

engaging each side string joint into the carrier tool at one of the threaded blind bores;

lowering the carrier string and side strings into the wellbore using a first elevator until the side strings are below the slip and the rig floor and the carrier string is above the rig floor and slip;

landing the carrier string in the slip to suspend the carrier string and side strings within the wellbore;

attaching one of the carrier string joints to the carrier string using the first elevator to lift the carrier string joint;

raising the carrier string from the wellbore with the first elevator until the side strings are above the rig floor;

suspending the carrier string with the first elevator to suspend the carrier string and side strings; and attaching additional side string joints to each side string using a second elevator or winch line to lift the side string joints; and repeating the lowering, landing, attaching, raising, suspending, and attaching steps until the carrier string and side strings are lowered into the wellbore to a desired depth.

13. A carrier tool for installing multiple strings within a wellbore in combination with a carrier string having a plurality of carrier string joints and at least one side string, each side string having a plurality of side string joints, wherein the carrier tool transfers the weight of the side strings to the carrier string enabling the side strings to be suspended, raised or lowered by suspending, raising, or lowering the carrier string, the carrier tool comprising:

a body having an upper surface extending radially relative to the axis of the wellbore;

an axially extending threaded through bore in said body extending therethrough for engaging the carrier string; and at least one axially extending threaded blind bore in said body extending axially from said upper surface for engaging the side strings.

14. The carrier tool as defined in claim 13 wherein the carrier string and or side strings include segments which will be perforated, the perforated segments corresponding to a desired production or injection zone within the wellbore when the carrier string and side strings are lowered into the wellbore and wherein the carrier string and side strings are rigidly connected together using a clamp attached intermittently along the perforated segments.

15. The carrier tool as defined in claim 14 wherein spacers are substituted for clamps along segments other than perforated segments.

16. The carrier tool as defined in claim 15 wherein a centralizer having a hinge attaches around each clamp or spacer to keep the carrier string and side strings centered within the wellbore.

17. The carrier tool as defined in claim 16 wherein the at least one axially extending threaded blind bore comprises a single axially extending threaded blind bore.

18. The carrier tool as defined in claim 16 wherein the at least one axially extending threaded blind bore comprises two axially extending threaded blind bores.

19. The carrier tool as defined in claim 16 wherein the at least one axially extending threaded blind bore comprises four axially extending threaded blind bores.

20. A carrier tool for installing multiple strings within a wellbore in combination with a carrier string having a plurality of carrier string joints and at least one side string, each side string having a plurality of side string joints, the carrier string and/or the side strings including segments which will be perforated, the perforated segments corresponding to a desired production or injection zone within the wellbore when the carrier string and the side strings are lowered into the wellbore, the carrier string and the side strings being rigidly connected together using a clamp attached intermittently along the perforated segments, the carrier string and the side strings being intermittently attached by spacers along segments other than the perforated segments, wherein a centralizer is attached adjacent each clamp or spacer to keep the carrier string and the side strings centered within the wellbore, wherein the carrier tool transfers the weight of the side strings to the carrier string enabling the side strings to be suspended, raised or lowered, by suspending, raising or lowering, the carrier string, the carrier tool comprising:

a body having an upper surface extending radially relative to the axis of the wellbore;

an axially extending threaded through bore in said body extending therethrough for engaging the carrier string; and at least one axially extending threaded blind bore in said body extending axially from said upper surface for engaging at least one of the side strings.

21. A carrier tool for installing multiple strings within a wellbore in combination with a carrier string having a plurality of carrier string joints and at least two side strings, each side string having a plurality of side string joints, the carrier string and/or side strings including segments which will be perforated, the perforated segments corresponding to a desired production or injection zone within the wellbore when the carrier string and side strings are lowered into the wellbore, the carrier string and side strings being rigidly connected together using a clamp attached intermittently along the perforated segments, the carrier string and side strings being intermittently attached by spacers along segments other than the perforated segments, wherein a centralizer is attached adjacent each clamp or spacer to keep the carrier string and side strings centered within the wellbore, wherein the carrier tool transfers the weight of the side strings to the carrier string enabling the side strings to be suspended, raised, or lowered, by suspending, raising, or lowering, the carrier string, the carrier tool comprising:

a body having an upper surface extending radially relative to the axis of the wellbore;

an axially extending threaded through bore in said body extending therethrough for engaging the carrier string; and at least two axially extending threaded blind bores in said body extending axially from said upper surface for engaging at least two of the side strings.

22. In combination:

a carrier string having a plurality of carrier string joints;

at least one side string, each side string having a plurality of side string joints; and a carrier tool for transferring the weight of the side strings to the carrier string enabling the side strings to be suspended, raised, or lowered within a wellbore by suspending, raising and lowering the carrier string, the carrier tool including, a body having an upper surface extending radially relative to the axis of the wellbore, an axially extending threaded through bore in said body extending therethrough for engaging the carrier string, and at least one axially extending threaded blind bore in said body extending axially from said upper surface for engaging the at least one side string.

23. The combination as defined in claim 22, wherein a segment of the carrier string and or side strings will be perforated, the perforated segments corresponding to a desired production or injection zone within the wellbore when the carrier string and side strings are lowered into the wellbore, the combination further comprising:

a plurality of clamps for maintaining the spacing and orientation of the carrier string and side strings to one another, wherein the clamps attach to the carrier string and side strings intermittently along the perforated segments.

24. The combination as defined in claim 23 wherein spacers are substituted for clamps along segments other than perforated segments.

25. The combination as defined in claim 24 wherein a centralizer having a hinge attaches around each clamp or spacer to keep the carrier string and side strings centered within the wellbore.

26. The carrier tool as defined in claim 25 wherein the at least one axially extending threaded blind bore comprises a single axially extending threaded blind bore.

27. The carrier tool as defined in claim 25 wherein the at least one axially extending threaded blind bore comprises two axially extending threaded blind bores.

28. The carrier tool as defined in claim 25 wherein the at least one axially extending threaded blind bore comprises four axially extending threaded blind bores.

29. In combination:

a carrier string having a plurality of carrier string joints;

at least one side string, each side string having a plurality of side string joints;

wherein, a segment of the carrier string and/or the side strings will be perforated, the perforated segments corresponding to a desired production or injection zone within the wellbore when the carrier string and the side strings are lowered into the wellbore;

the carrier strings and the side strings being connected by a plurality of clamps for maintaining the spacing and orientation of the carrier string and the side strings to one another, the clamps being attached to the carrier string and the side strings intermittently along the perforated segments;

wherein, spacers are substituted for clamps along segments other than perforated segments;

wherein a centralizer attaches adjacent each clamp or spacer to keep the carrier string and the side strings centered within the wellbore;

a carrier tool for transferring the weight of the side strings to the carrier string enabling the side strings to be suspended, raised, or lowered within a wellbore by suspending, raising, or lowering the carrier string, the carrier tool including;

a body having an upper surface extending radially relative to the axis of the wellbore, an axially extending threaded through bore in said body extending therethrough for engaging the carrier string, and at least one axially extending threaded blind bore in said body extending axially from said upper surface for engaging the at least one of the side strings.

30. In combination:

a carrier string having a plurality of carrier string joints;

at least two side strings, each side string having a plurality of side string joints;

wherein, a segment of the carrier string and or side strings will be perforated, the perforated segments corresponding to a desired production or injection zone within the wellbore when the carrier string and side strings are lowered into the wellbore;

the carrier strings and side strings being connected by a plurality of clamps for maintaining the spacing and orientation of the carrier string and side strings to one another, the clamps being attached to the carrier string and side strings intermittently along the perforated segments;

wherein, spacers are substituted for clamps along segments other than perforated segments;

wherein a centralizer attaches adjacent each clamp or spacer to keep the carrier string and side strings centered within the wellbore; and a carrier tool for transferring the weight of the side strings to the carrier string enabling the side strings to be suspended, raised, or lowered within a wellbore by suspending, raising, or lowering the carrier string, the carrier tool including;

a body having an upper surface extending radially relative to the axis of the wellbore, an axially extending threaded through bore in said body extending therethrough for engaging the carrier string, and at least two axially extending threaded blind bores in said body extending axially from said upper surface for engaging at least two of the side strings.

* * * * *

UNITED STATES PATENT AND TRADEMARK OFFICE

CERTIFICATE OF CORRECTION

PATENT NO. : 6,305,475 B1
DATED : October 23, 2001
INVENTOR(S) : Brent D. Carnahan It is certified that error appears in the above-identified patent and that said Letters Patent is hereby corrected as shown below:

Column 7,
Lines 30 and 33, replace "too 10" with -- tool 10 --.

Column 9,
Line 4, replace "joint **56*a*, 56b, and 56C" with -- joints 56*a*, 56b and 56C** --.
Line 25, replace "sip" with -- slip --.

Column 11,
Line 38, after "connected by" delete "a".
Line 53, after "connected by" delete "a".

Column 12,
Line 2, after "connected by" delete "a".
Line 53, replace "strings joints" with -- string joints --.

Column 13,
Line 30, replace "fig" with -- rig --.

Column 16,
Line 66, replace "and or" with -- and/or --.

Column 18,
Line 17, replace "and or" with -- and/or --.

Signed and Sealed this

Twenty-eighth Day of January, 2003

JAMES E. ROGAN
*Director of the United States Patent and Trademark Office*